US012408806B2

(12) United States Patent
Sit et al.

(10) Patent No.: US 12,408,806 B2
(45) Date of Patent: Sep. 9, 2025

(54) CLEANING WHEEL INCLUDING REELS AND TRANSMISSION FOR CLEANING FILM

(71) Applicant: AUO Corporation, Hsin-Chu (TW)

(72) Inventors: Chung Hang Sit, Hsin-Chu (TW); Wen Long Shu, Hsin-Chu (TW); Chun Kuan Wu, Hsin-Chu (TW); Yu-Chung Hsu, Hsin-Chu (TW); Kun-Chu Wang, Hsin-Chu (TW); Yu Cheng Ou, Hsin-Chu (TW); Jiun-Ying Yu, Hsin-Chu (TW); Bing Hung Yang, Hsin-Chu (TW); Hung-Ta Chiu, Hsin-Chu (TW); Yu-Cheng Wang, Hsin-Chu (TW)

(73) Assignee: AUO CORPORATION, Hsin-Chu (TW)

( * ) Notice: Subject to any disclaimer, the term of this patent is extended or adjusted under 35 U.S.C. 154(b) by 304 days.

(21) Appl. No.: 18/074,865

(22) Filed: Dec. 5, 2022

(65) Prior Publication Data

US 2023/0190066 A1 Jun. 22, 2023

Related U.S. Application Data

(60) Provisional application No. 63/292,600, filed on Dec. 22, 2021.

(30) Foreign Application Priority Data

Jul. 12, 2022 (TW) ..... 111126172

(51) Int. Cl.

| | |
|---|---|
| ***A47L 11/40*** | (2006.01) |
| ***A47L 11/14*** | (2006.01) |
| ***A47L 25/00*** | (2006.01) |

(52) U.S. Cl.
CPC ..... *A47L 11/4069* (2013.01); *A47L 11/14* (2013.01); *A47L 25/005* (2013.01)

(58) Field of Classification Search
CPC .... A47L 25/00; A47L 25/005; A47L 11/4063; A47L 11/4047; A47L 11/16; A47L 11/4069; A47L 11/40; A47L 11/4036
See application file for complete search history.

(56) References Cited

U.S. PATENT DOCUMENTS 3,883,921 A * 5/1975 Thettu ..... G03G 21/0058 399/327
4,575,890 A * 3/1986 Hidle ..... A47L 25/005 451/493

(Continued)

FOREIGN PATENT DOCUMENTS

CN 1676230 A 10/2005
JP 4136136 B2 * 8/2008 ..... B65H 37/007

(Continued)

OTHER PUBLICATIONS

"PP Sticky Roller for Cleaning Machine" https://www.jejorwiper.com/sticky-roller/pp-sticky-roller/pp-sticky-roller-for-cleaning-machine.html.

(Continued)

*Primary Examiner* — Carlos A. Rivera
(74) *Attorney, Agent, or Firm* — WPAT, PC

(57) ABSTRACT

A cleaning equipment includes a first take-up reel, a first supply reel, a frame, a first cleaning film, and a transmission assembly. The frame includes an inner space accommodating the first take-up reel and the first supply reel side by side and an outer surface having at least one gap communicating with the inner space. The first cleaning film has a supply part on the first supply reel, a take-up part on the first take-up reel, and a middle part at least partially covering the outer surface of the frame. Two ends of the middle part enter the (Continued)

inner space through the at least one gap and are connected to the supply part and the take-up part, respectively. The transmission assembly is coupled to the first supply reel and the first take-up reel and drives at least one of the first supply reel and the first take-up reel to rotate.

29 Claims, 17 Drawing Sheets

(56) References Cited

U.S. PATENT DOCUMENTS

| | | | | |
|---|---|---|---|---|
| 7,198,219 | B1 * | 4/2007 | Alajajyan | A01K 89/0183 242/290 |
| 10,154,773 | B1 | 12/2018 | Pham | |

FOREIGN PATENT DOCUMENTS

| | | | |
|---|---|---|---|
| TW | 202045268 | A | 12/2020 |
| WO | WO2015134112 | A1 | 9/2015 |

OTHER PUBLICATIONS

TIPO has issued the Office Action for the corresponding Taiwan application on Mar. 16, 2023.

* cited by examiner

CLEANING WHEEL INCLUDING REELS AND TRANSMISSION FOR CLEANING FILM

CROSS REFERENCE TO THE RELATED APPLICATION

The application claims the benefit of U.S. Provisional Application No. 63/292,600, filed on Dec. 22, 2021 and Taiwan Application No. 111126172, filed on Jul. 12, 2022. The entirety of each of the mentioned above patent application is hereby incorporated by reference herein and made a part of this specification.

BACKGROUND OF THE INVENTION

1. Field of the Invention

The present invention relates to a cleaning equipment and a cleaning method. Specifically, the present invention relates to a non-blow/suction type dust collecting cleaning equipment with an inner roll structure and a cleaning method thereof.

2. Description of the Prior Art

With the continuous advancement of science and technology, all kinds of machinery and equipment are also moving towards the goal of complete automation. To achieve the purpose of reducing manpower requirements, autonomous cleaning equipment is gradually introduced in both home and factory cleaning. For example, the current common sweeping robots have become the home cleaning choice for many users. At present, the common automatic floor cleaning equipment on the market are all suction/blow type dust collectors, that is, airflow is generated through pressure to inhale or blow away dust and garbage. However, the airflow generated by suction/blow dust collectors may cause turbulence in areas that require strict control of the indoor environment (such as clean rooms, laboratories, etc.), thereby causing secondary pollution.

In addition to the suction/blow type cleaning equipment, there are also adhesive cleaning rollers on the market. These cleaning rollers mainly rely on the adsorptive capacity of the surface of the adhesive paper to remove the dirt without generating airflow like the suction/blow type cleaning equipment. However, the use of such products usually requires manual operation, and when the surface of the cleaning roller no longer has the adsorptive capacity, the cleaning paper on the surface needs to be manually removed for continued use. Therefore, although the current adhesive roller can avoid the problem of turbulence, it cannot achieve the purpose of automation to reduce manpower requirements. Therefore, cleaning equipment and method that is automated and does not cause turbulence during cleaning would be desirable in the industry.

SUMMARY OF THE INVENTION

The present invention is to provide cleaning equipment and method, which can achieve automatic target surface (e.g., ground) cleaning.

The present invention is to provide cleaning equipment and method, which can avoid causing turbulent flow, thereby preventing secondary pollution to the equipment in the clean room, laboratory, and other spaces.

In one embodiment, the cleaning equipment includes a first take-up reel; a first supply reel; a frame, comprising an outer surface and an inner space located inside the outer surface, wherein the outer surface has at least one gap communicating with the inner space, and the inner space accommodates the first take-up reel and the first supply reel side by side; a first cleaning film with a supply part, a take-up part and a middle part, wherein the first cleaning film has adsorptive capacity, the supply part is arranged on the first supply reel, the take-up part is arranged on the first take-up reel, at least part of the middle part covers the outer surface of the frame, and two ends of the middle part respectively enter the inner space through the at least one gap and are respectively connected to the supply part and the take-up part; and a transmission assembly coupled to the first supply reel and the first take-up reel and configured to drive at least one of the first supply reel and the first take-up reel to rotate.

In one embodiment, the cleaning method includes pulling at least part of a first cleaning film arranged on a first supply reel out to leave an inner space of a frame through at least one gap of the frame, cover an outer surface of the frame, and then enter the inner space again through the at least one gap and be arranged on a first take-up reel, wherein the part of the first cleaning film arranged on the first supply reel becomes a supply part, the part covering the outer surface becomes a middle part, and the part arranged on the first take-up reel becomes a take-up part, the first supply reel and the first take-up reel are arranged side by side in the inner space, and the first cleaning film has absorptive capacity; and operating a transmission assembly coupled to the first supply reel and the first take-up reel to drive at least one of the first supply reel and the first take-up reel to rotate, wherein in response to rotation of the first take-up reel, at least part of the middle part becomes the take-up part, and in response to rotation of the first supply reel, at least part of the supply part leaves the first supply reel and becomes at least part of the middle part.

BRIEF DESCRIPTION OF THE APPENDED DRAWINGS

DETAILED DESCRIPTION OF THE INVENTION

Figure 1A:
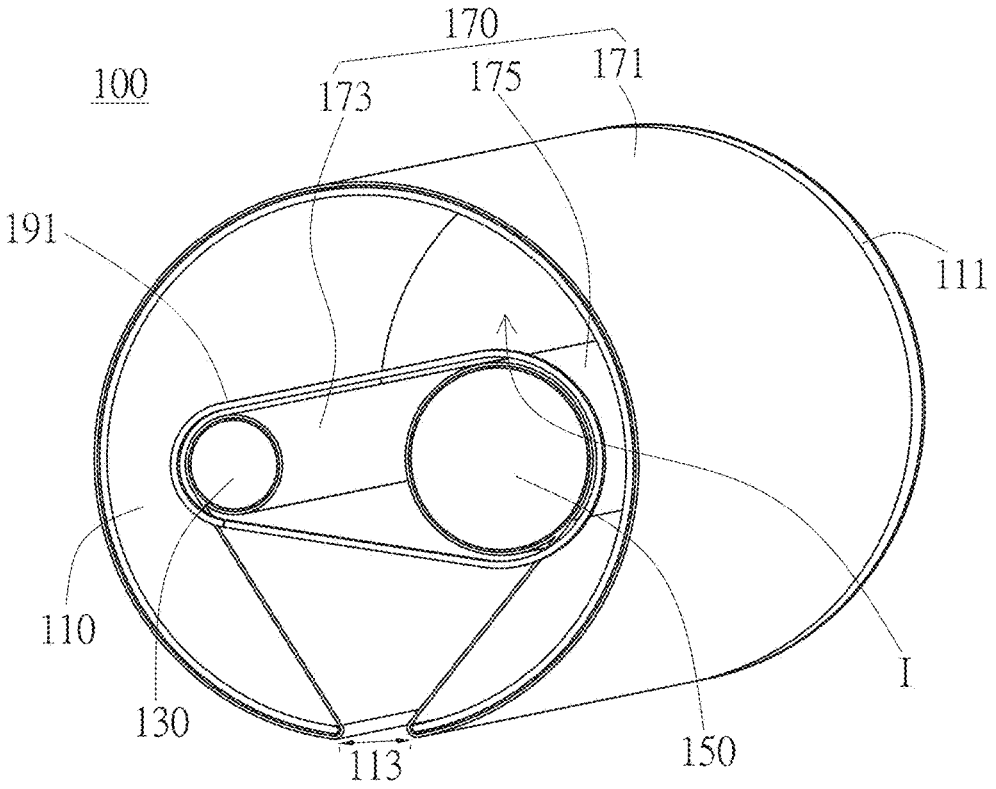
FIG. 1A and FIG. 1B show schematic diagrams of different angles of the cleaning equipment according to a first embodiment of the present invention.

The present invention is described below through specific embodiments and the accompanying drawings, and those skilled in the art can understand the advantages and effects of the present invention from the contents disclosed in this specification. However, the content disclosed below is not intended to limit the scope of the present invention, and those skilled in the art can implement the present invention with other different embodiments without departing from the spirit of the present invention.

In the drawings, the sizes of various components and modules are enlarged for clarity. Throughout the specification, the same reference numerals refer to the same elements. It will be understood that when an element is referred to as being "on" or "connected to" another element, it can be directly on or connected to the other element or intervening elements may also be present. In contrast, when an element is referred to as being "directly on" or "directly connected to" another element, there are no intervening elements present. As used herein, "connected" may refer to a physical and/or electrical connection. Furthermore, "electrically connected" or "coupled" may refer to the existence of other elements between the two elements.

It will be understood that, although the terms "first", "second", and "third" may be used herein to describe various elements, components, regions, layers, and/or parts, these elements, components, regions, and/or parts shall not be limited by these terms. These terms are only used to distinguish one element, component, region, layer, or part from another element, component, region, layer, or part. Thus, "first supply reel", "first take-up reel" or "first cleaning film" discussed below may be referred to as a second supply reel, take-up reel, or cleaning film without departing from the teachings herein.

The term used herein is to describe particular embodiments only and is not limiting. As used herein, the singular forms "a", "an", and "the" are intended to include the plural forms, including "at least one" unless the content dictates otherwise. "Or" means "and/or". As used herein, the term "and/or" includes any combinations of one or more of the associated listed items. It will also be understood that, when used in this specification, the terms "comprising" and/or "including" designate the presence or addition of stated features, regions, integers, steps, operations, elements, and/or components, but do not exclude the presence or addition of one or more other features, regions, integers, steps, operations, elements, components and/or combinations thereof.

Referring to FIG. 1A, the cleaning equipment 100 according to the first embodiment of the present invention is illustrated. The cleaning equipment 100 includes a hollow cylindrical frame 110. Frame 110 includes an outer surface 111, an inner space I, and a gap 113. The inner space I is the hollow part of the cylindrical frame 110, and the gap 113 extends along the axial direction of the cylindrical frame 110 and communicates with the inner space I. The inner space I accommodates the first take-up reel 130 and the first supply reel 150. The first take-up reel 130 is arranged with the take-up part 173 of the first cleaning film 170, and the first supply reel 150 is arranged with the supply part 175 of the first cleaning film 170. In this embodiment, "arranged" may refer to winding the take-up part 173 and the supplying part 175 respectively round the axes of the first take-up reel 130 by clockwise and the first supply reel 150 counterclockwise. At least part of the middle part 171 of the first cleaning film 170 covers the outer surface 111 and enters the inner space I through the gap 113 to connect the supply part 175 and the take-up part 173, respectively. The first cleaning film 170 has adsorptive capacity. It should be noted that the adsorptive capacity described herein may be the adsorptive capacity caused by contact or the adsorptive capacity not caused by contact (e.g., electrostatic force), which is not limited in the present invention.

Figure 1B:
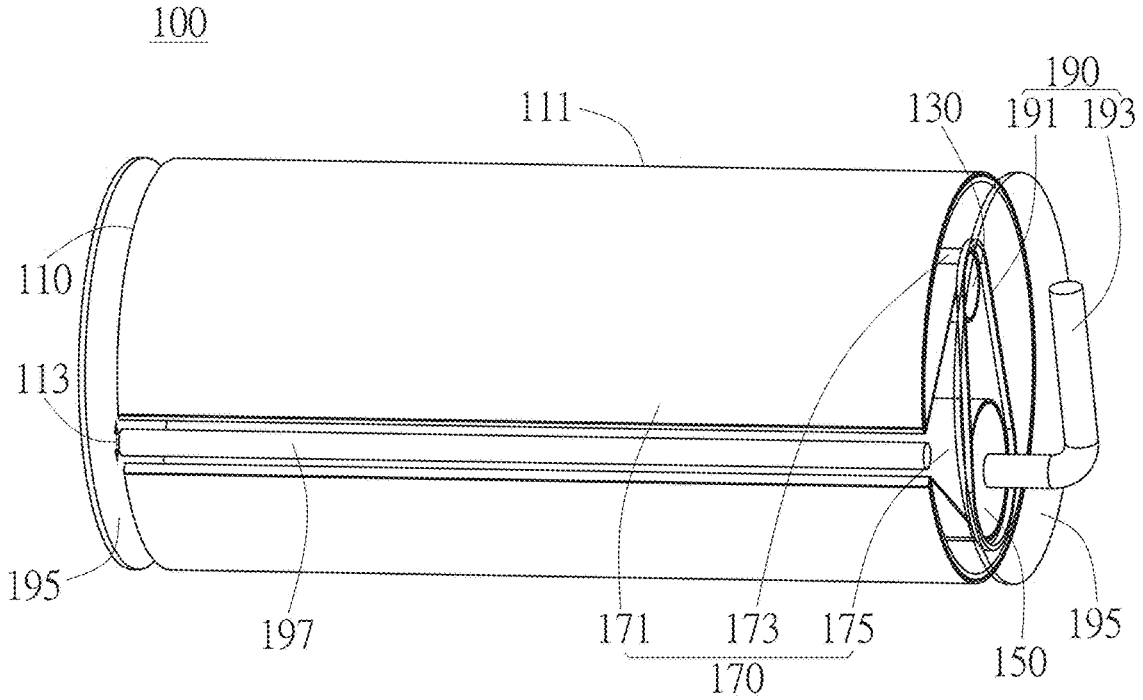

Continuing to refer to the variant embodiment shown in FIG. 1B, the cleaning equipment 100 further includes a transmission assembly 190, which drives at least one of the first supply reel 150 and the first take-up reel 130 to rotate when it operates. In this embodiment, the transmission assembly 190 includes a belt 191 and a handle 193. The belt 191 is simultaneously coupled to the first take-up reel 130 and the first supply reel 150 (e.g., coupled by the gears or gear plate at the ends of the first take-up reel 130 and the first supply reel 150), and the handle 193 is coupled to the first supply reel 150. In different embodiments, the handle 193 can be coupled to the first take-up reel 150, which is not limited in the present invention. The operation of the transmission assembly 190 refers to that when the handle 193 is turned clockwise by an external force, the belt 191 drives the first take-up reel 130 to rotate clockwise in response to the clockwise rotation of the first supply reel 150. Since the take-up part 173 and the supply part 175 wind round the first take-up reel 130 and the first supply reel 150 in a clockwise and counterclockwise manner respectively, when the first take-up reel 130 and the first supply reel 150 rotate clockwise at the same time, at least part of the supply part 175 leaves the first supply reel 150 to become the middle part 171, and at least part of the middle part 171 is wound around the first take-up reel 130 to become the take-up part 173. With this configuration, the middle part 171 originally covering the outer surface 111 is wound up by the first take-up reel 130, and part of the supply part 173 arranged on the first supply reel 150 replaces the original middle part 171 and covers the outer surface 111, so as to achieve the purpose of replacing the middle part of the first cleaning film 170 covering the outer surface 111, i.e., alternatingly covering the outer surface 111 with the unwound portion of the first cleaning film 170.

It should be noted that the direction of the winding and rotation (i.e., clockwise or counterclockwise) are all exemplary, and other directions may be used in different embodiments. For example, the take-up part and the supply part can be respectively winded round counterclockwise and clockwise, and the first take-up reel 130 and the first supply reel 150 can rotate counterclockwise, which is not limited in the present invention.

In addition, the cleaning equipment 100 may further include a guard plate 195 and an anti-stick strip 197, wherein the guard plate 195 is disposed of at the end of the axial direction (one side or both sides) of the frame 110 to prevent dust and dirt from entering the inner space I. The anti-stick strip 197 is located in gap 113 and extends parallel to the extending direction (i.e., the axial direction) of frame 110 and gap 113. Preferably, the anti-stick strip 197 does not protrude from the outer surface 111 and does not contact frame 110. That is to say, the anti-stick strip 197 divides gap 113 into two parallel long gaps. In this embodiment, the anti-stick strip 197 is coupled to the guard plate 195 and is cylindrical, but in different embodiments, the anti-stick strip 197 can have different shapes (e.g., a diamond-shaped column), which is not limited in the present invention. With this configuration, both ends of the middle part 171 will be separated by the anti-stick strips 197 when they respectively enter the inner space I through the gap 113, thereby preventing them from sticking to each other.

Figure 2:
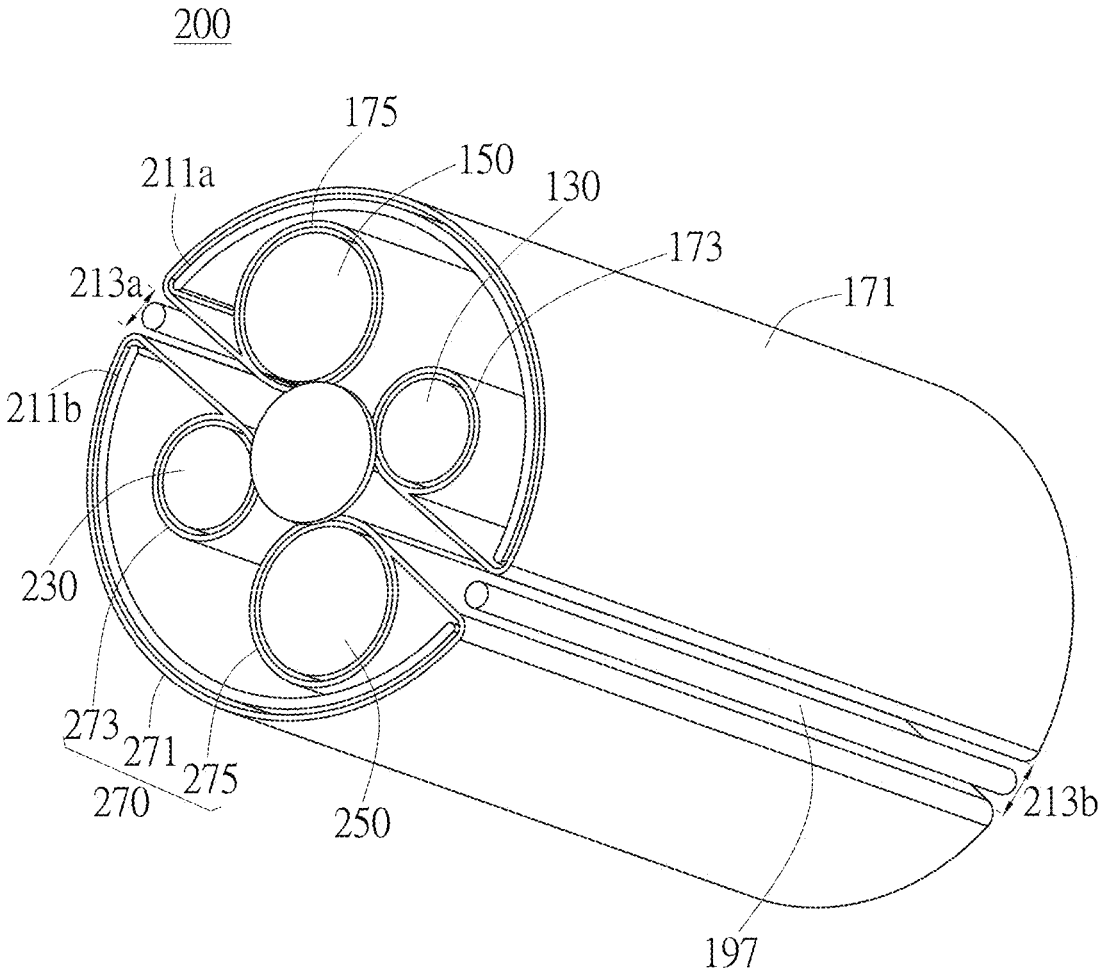
FIG. 2 shows a schematic diagram of the cleaning equipment with the second take-up reel and the second supply reel according to a second embodiment of the present invention.

Referring to FIG. 2, the cleaning equipment 200 according to the second embodiment of the present invention is illustrated. The cleaning equipment 200 has a structure similar to that of the cleaning equipment 100 of the first embodiment, and further includes a second take-up reel 230, a second supply reel 250, and a second cleaning film 270. In addition, frame 110 includes a first gap 213*a* and a second gap 213*b*, and the first gap 213*a* and the second gap 213*b* divide the outer surface 111 into a first outer surface 211*a* and a second outer surface 211*b*. The second cleaning film 270 has the same structure as the first cleaning film 170 with a middle part 271, a take-up part 273, and a supply part 275. The take-up part 273 is arranged on the second take-up reel 230, and the supply part 275 is arranged on the second supply reel 250. The middle parts 171 and 271 of the first cleaning film 170 and the second cleaning film 270 respectively cover the first outer surface 211*a* and the second outer surface 211*b*, and both ends of the middle parts 171 and 271 enter the inner space I through the first gap 213*a* and the second gap 213*b* respectively, to connect the take-up parts 173, 273 and the supply parts 175, 275. In addition, when the transmission assembly 190 operates, it can drive the first take-up reel 130, the second take-up reel 230, the first supply reel 150, and the second supply reel 250 to rotate clockwise or counterclockwise (for details, refer to FIG. 8A to FIG. 8D), thereby achieving the purpose of alternatingly covering the outer surface 111 with unwound portions of the cleaning films (i.e., the first cleaning film 170 and the second cleaning film 270) as described above.

Figure 3B:
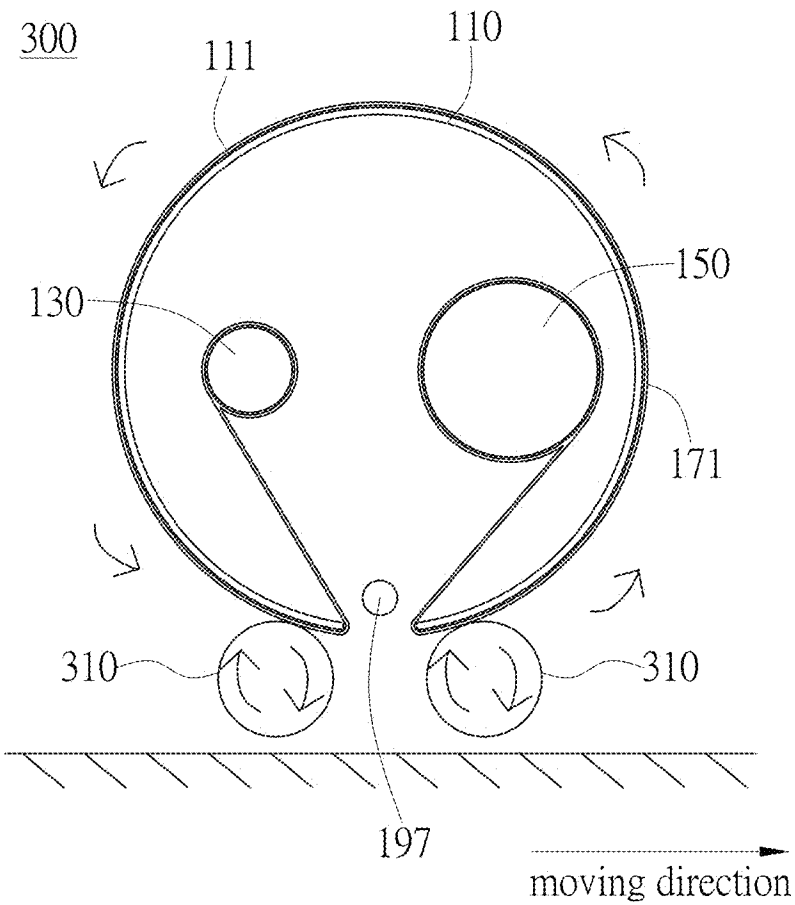
FIG. 3A and FIG. 3B show schematic diagrams of the cleaning equipment with the cleaning wheel according to a third embodiment of the present invention.
Figure 3A:
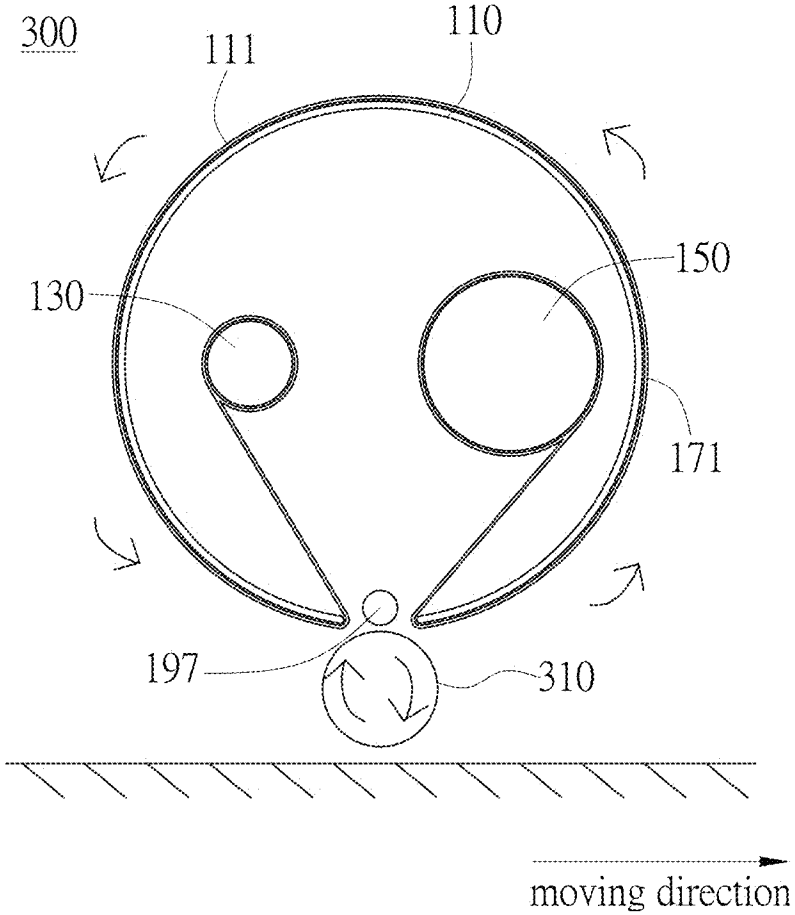

FIG. 3A and FIG. 3B illustrate a cleaning equipment 300 according to the third embodiment of the present invention. The cleaning equipment 300 may have a structure similar to that of the cleaning equipment 100 or 200, and further includes a cleaning wheel 310. It should be noted that, in order to concisely illustrate the present invention, the cleaning equipment 300 is shown in a manner similar to the cleaning equipment 100 (without the second take-up reel 230 and the second supply reel 250). However, the third embodiment described below with the drawings can have the structure of the cleaning equipment 100 or 200, which is not limited in the present invention.

First, referring to FIG. 3A, the cleaning wheel 310 is disposed under the frame 110 and contacts the middle part 171, which covers the outer surface 111. The adsorptive capacity of the cleaning wheel 310 is smaller than that of the first cleaning film 170. Since the axial direction of the cleaning wheel 310 is parallel to the axial direction of the frame 110, the entire cleaning equipment 300 is driven to move forward in a direction vertical to the axial direction of the frame 110 when the cleaning wheel 310 rotates, and the frame 110 is affected by the frictional force and rotates accordingly. It should be noted that although FIG. 3A shows only one cleaning wheel 310, in various embodiments, there may be a plurality of cleaning wheels 310 (e.g., referring to FIG. 3B showing cleaning equipment 300 having two cleaning wheels 310), which is not limited in the present invention.

Figures 4A, 4B, 4C:
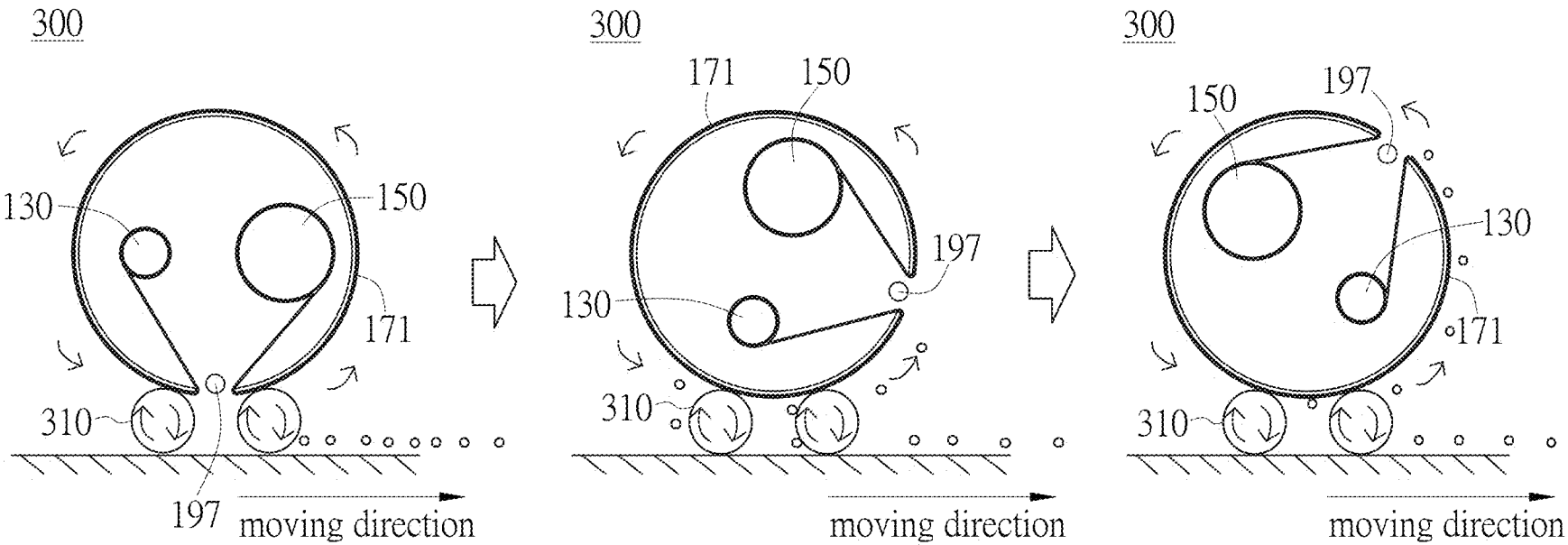
FIG. 4A to FIG. 4C show schematic diagrams illustrating a cleaning process performed by the cleaning equipment according to the third embodiment of the present invention.

FIG. 4A to FIG. 4C continue illustrating the cleaning equipment 300 according to the third embodiment of the present invention. Since the cleaning wheel 310 has an adsorptive capacity, when the cleaning wheel 310 contacts the target surface (such as the ground) during the rotation, it will adsorb the dust, garbage, and the like. Then, since the adsorptive capacity of the cleaning wheel 310 is smaller than that of the first cleaning film 170, when the part of the cleaning wheel 310 adsorbing the dirt contacts the middle part 171, the dirt will be passed on to the first cleaning film 170. With this configuration, the cleaning equipment 300 can adsorb the dirt on the target surface through the cleaning wheel 310, and then pass on the dirt to the first cleaning film 170, so that the cleaning wheel 310 maintains the adsorptive capacity, thereby achieving the purpose of cleaning the target surface.

Figure 5A:
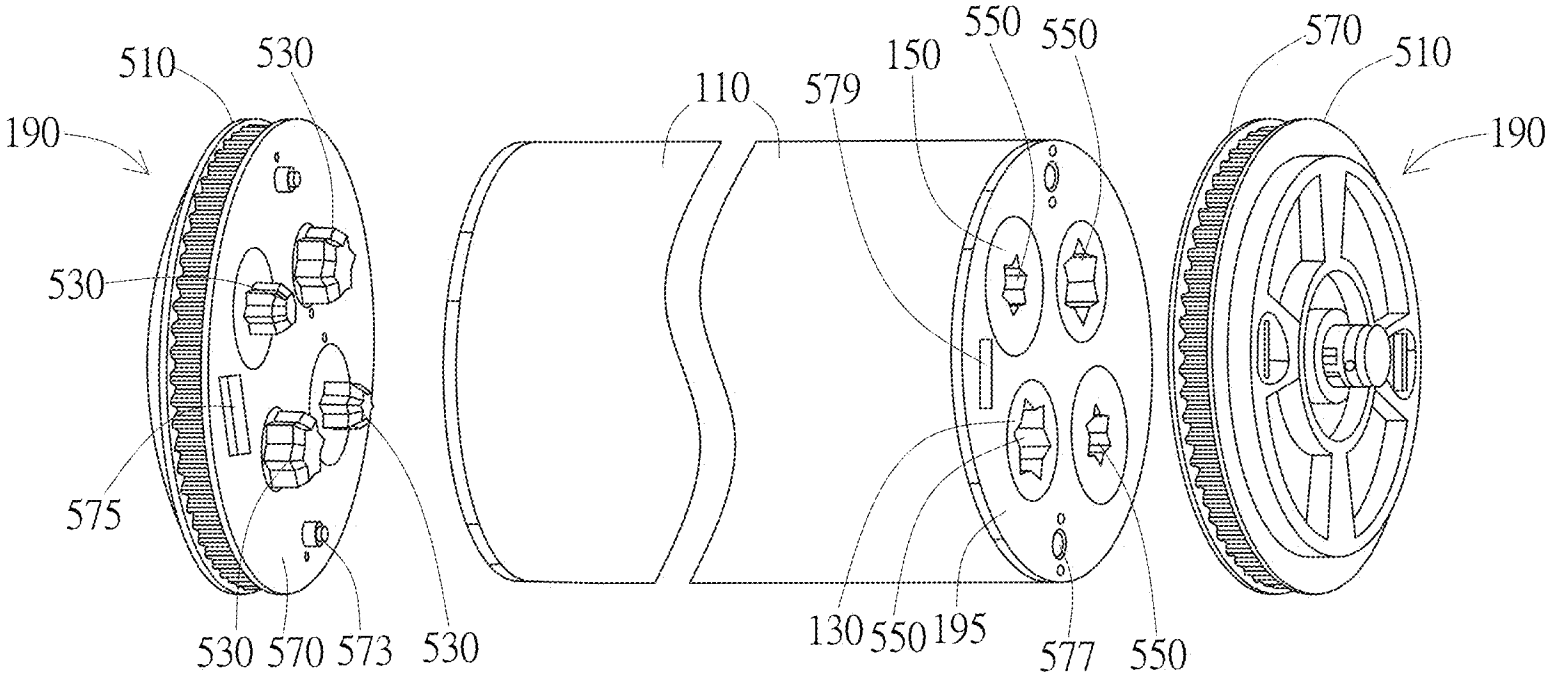
FIG. 5A shows a schematic exploded diagram of the cleaning equipment according to the third embodiment of the present invention.
Figure 5B:
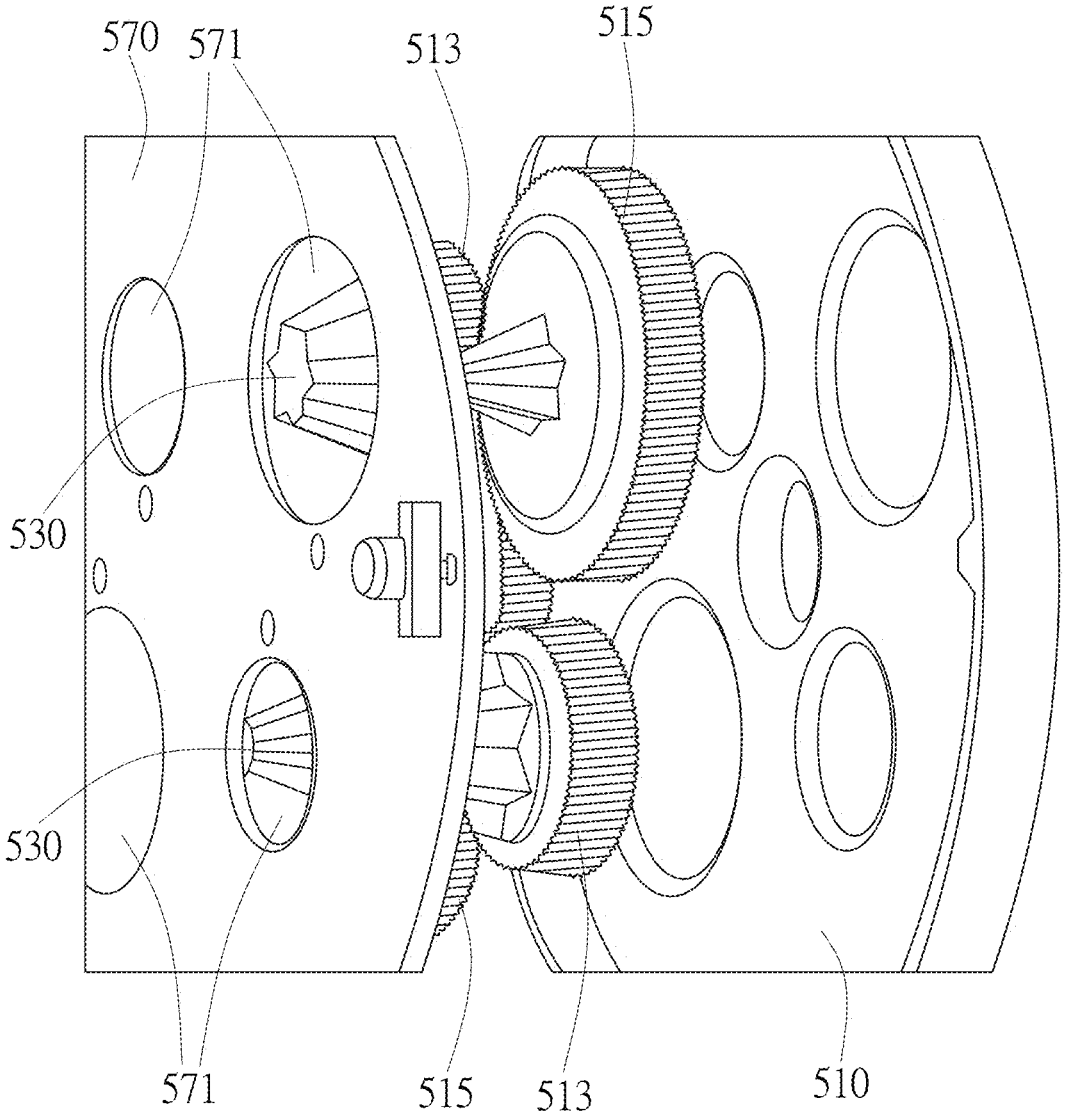
FIG. 5B shows a schematic exploded diagram of the transmission assembly shown in FIG. 5A.

FIG. 5A is a schematic exploded diagram of the detail between the frame 110 and the transmission assembly 190 according to an embodiment, and FIG. 5B is a schematic exploded diagram of the transmission assembly 190 according to the embodiment shown in FIG. 5A. In this embodiment, the transmission assembly 190 includes a gear plate 510 and a top plate 570, wherein the gear plate 510 has teeth protruding toward the radial direction around it, and the middle of the surface paralleling to the radial direction is recessed to accommodate the take-up gear 513 and the supply gear 515 (refer to FIG. 5B). The surfaces of the take-up gear 513 and the supply gear 515 both have a first tenon/mortise element 530, which are disposed on the side not contact the gear plate (i.e., the side facing the frame 110), and the first take-up reel 130 and the first supply reel 150 both have a second tenon/mortise element 550, which is arranged at the end of the axial direction (i.e., the surface facing the gear plate 510). The first tenon/mortise element 530 and the second tenon/mortise element 550 correspond to each other. Specifically, in this embodiment, the first tenon/mortise element 530 and the second tenon/mortise element 550 are respectively a polygonal convex piece and a polygonal concave piece, and the shapes and sizes are matched with each other. When the transmission assembly 190 is coupled to the frame 110, the first tenon/mortise element 530 and the second tenon/mortise element 550 can be combined. With this configuration, when the take-up gear 513 and the supply gear 515 rotate, the first tenon/mortise element 530 drives the second tenon/mortise element 550 to rotate, thereby causing the first take-up reel 130 and the first supply reel 150 to rotate, and to achieve the purpose of alternatingly covering the outer surface 111 with the unwound portion of the first cleaning film 170 as described above.

On the other hand, the second take-up reel 230 and the second supply reel 250 may have the similar structure as the first take-up reel 130 and the first supply reel 150. When the take-up gear 513 and the supply gear 515 rotate, the first tenon/mortise element 530 drives the second tenon/mortise element 550 to rotate, thereby causing the second take-up reel 230 and the second supply reel 250 to rotate accordingly, so as to achieve the purpose of alternatingly covering the outer surface 111 with the unwound portion of the second cleaning film 270. It should be noted that, although the first tenon/mortise element 530 is shown as a convex piece and the second tenon/mortise element 550 is shown as a concave piece, in different embodiments, the first tenon/mortise element 530 and the second tenon/mortise elements 550 may be other mutually matched structures (e.g., the first tenon/mortise element 530 is a concave piece, and the second tenon/mortise element 550 is a convex piece), which is not limited in the present invention.

Referring to FIG. 5B, the top plate 570 of the cleaning equipment 300 is coupled to the gear plate 510 to prevent dirt from entering the gear plate 510. The top plate 570 has top-plate holes 571 (the total number of which corresponds to the first take-up reel 130, the first supply reel 150, the second take-up reel 230, and the second supply reel 250) located corresponding to the take-up gear 513 and the supply gear 515, so that the first tenon/mortise element 530 can pass through the top-plate hole 571 and couple with the second tenon/mortise element 550. It should be noted that although the top-plate hole 571 is shown in a circular shape in this embodiment, its purpose is only to allow the first tenon/mortise element 530 to pass through without being blocked by the top plate 570, so it can be any suitable shape (for example, the same polygon as the first tenon/mortise element 530), which is not limited in the present invention.

Referring to FIG. 5A, the top plate 570 may further include a tenon 573 and an alignment parent element 575, and in this embodiment, the cleaning equipment 300 may include a guard plate 195 disposed on both ends of the frame 110 as in the first embodiment. The guard plate 195 has holes to expose the ends of the first take-up reel 130 and the first supply reel 150, and the guard plate 195 further includes a mortise 577 and an alignment child element 579 (see FIG. 5A). The tenon 573 corresponds to the mortise 577, so that the transmission assembly 195 can be combined with the frame 110, and the alignment parent element 575 corresponds to the alignment child element 579 (for example, the alignment parent element 575 can be a long strip protrusion, an alignment child element 579 can be a long strip groove of the same shape as the alignment parent element 575) to facilitate quick alignment when combining the transmission assembly 190 with the frame 110. It should be noted that the aforementioned arrangement of the tenon 573, the mortise 577, the alignment parent element 575, and the alignment child element 579 are only exemplary, and in different embodiments, there may be other arrangements (for example, the tenon 573 is arranged in the guard plate 195, and the mortise 577 is arranged on the top plate 570, etc.), which is not limited in the present invention.

Figure 6A:
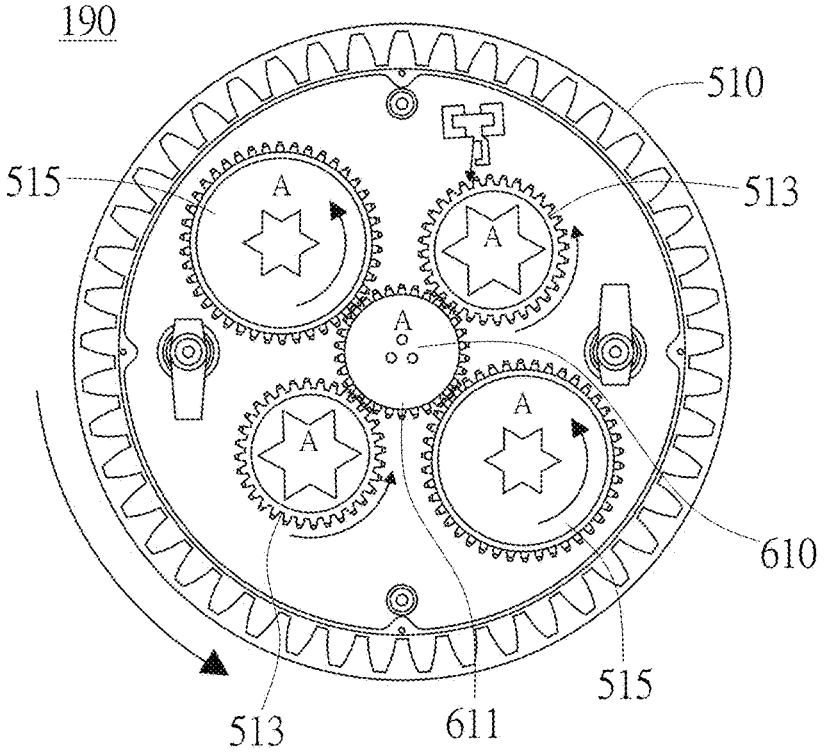
FIG. 6A shows a schematic diagram of the interior of the gear plate of the cleaning equipment according to the third embodiment of the present invention.
Figure 6B:
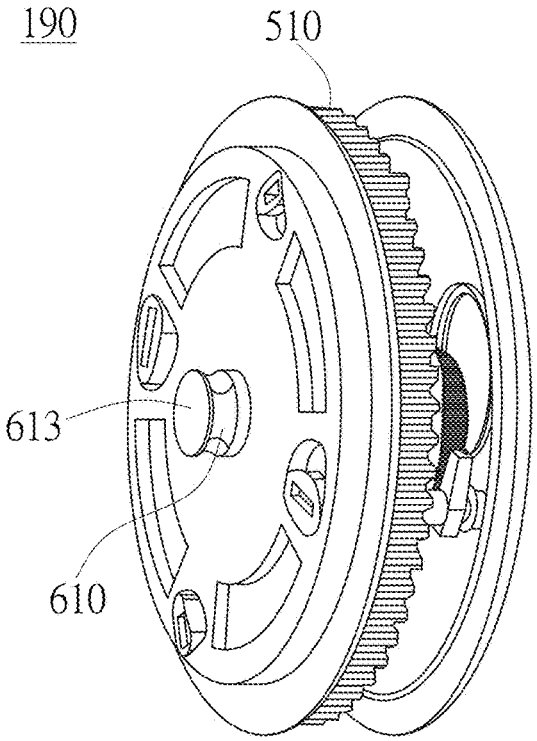
FIG. 6B shows a rear side view of the gear plate of the cleaning equipment according to the third embodiment of the present invention.

FIG. 6A shows the internal structure of the gear plate 510 according to an embodiment, and FIG. 6B is a rear side view of the gear plate 510 of the embodiment shown in FIG. 6A. In this embodiment, the cleaning equipment 300 further includes a control element 610. The control element 610 passes through the gear plate 510 and is provided with a control gear 611 inside the gear plate 510 and a limit element 613 outside the gear plate 510 (i.e., the side not provided with the take-up gear 513 and the supply gear 515). For the description of the limit element, please refer to FIG. 7A, FIG. 7B, and FIG. 7C. The limit element 613 has a linkage with the control gear 611 (that is, when the limit element 613 is fixed, the control gear 611 will not be able to rotate; when the limit element 613 is rotated, the control gear 611 will rotate accordingly), and the control gear 611 meshes with the take-up gear 513 and the supply gear 515, respectively.

Figures 7A, 7B, 7C:
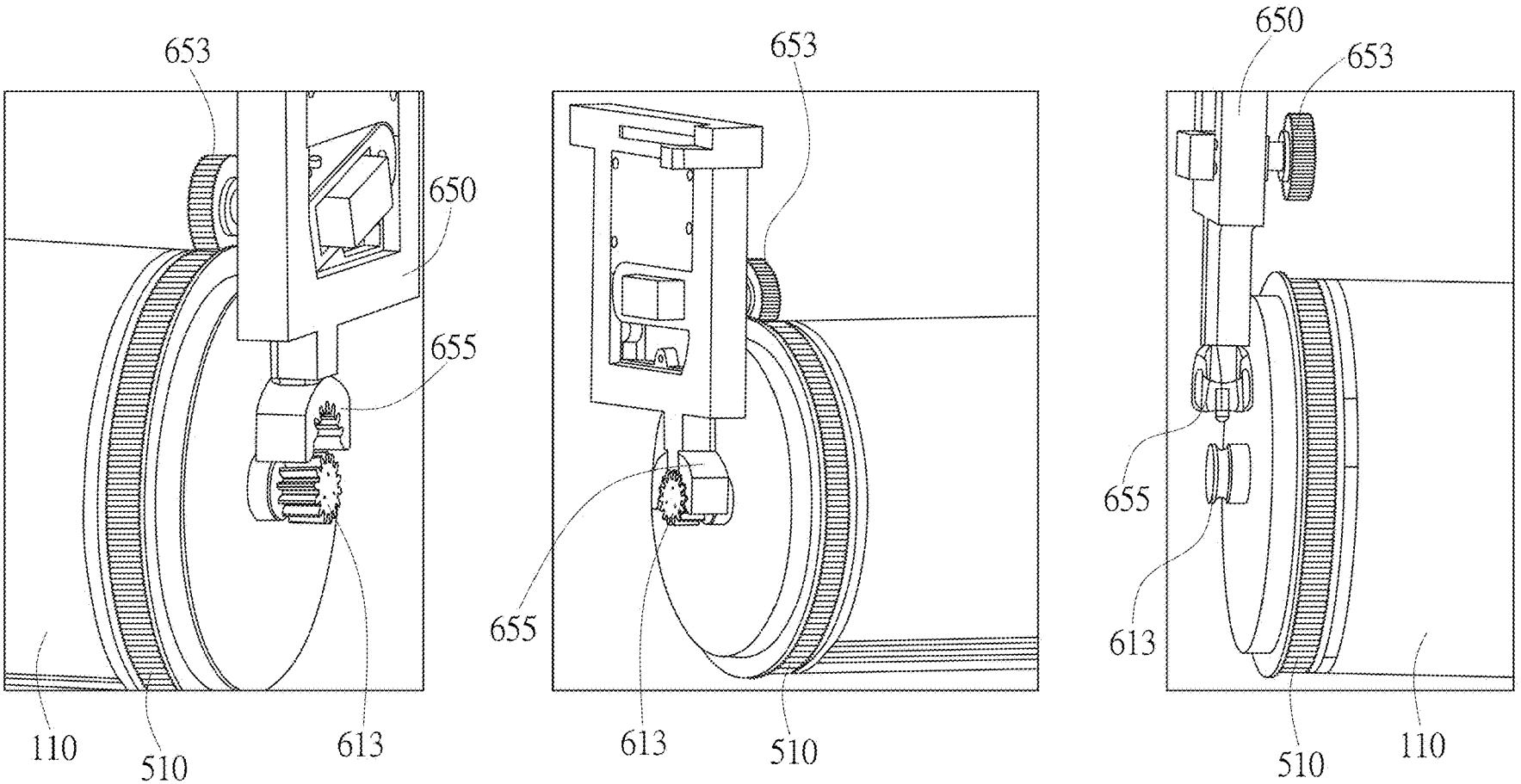
FIGS. 7A to FIG. 7C show schematic diagrams of fixing the limit element according to the third embodiment of the present invention.

Referring to FIG. 7A the illustration of the cleaning equipment 300 according to the third embodiment of the present invention is continued. In this embodiment, the cleaning equipment 300 further includes a driving module 650, which includes a fixer 655 for fixing the limit element 613. FIG. 7A shows the limit element 613 and its corresponding fixer 655. In this embodiment, the limit element 613 is a gear (hereinafter referred to as a fix gear), and the fixer 655 has a shape corresponding to the teeth profile of the fix gear. Specifically, the fixer 655 may have protruding parts that can be properly filled into the tooth space of the fix gear (for example, the distribution of the protruding parts is the same as the tooth space, and the width of the protruding parts is the same as that of the tooth space). Under this configuration, when the fixer 655 is combined with the limit element 613, the fix gear can be fixed so that it cannot rotate (refer to FIG. 7B), so as to fix the control gear 611 disposed of in the gear plate 510 to implement the first operation mode of the transmission assembly 190 illustrated in FIG. 8A and FIG. 8B.

It should be noted that although the limit element 613 is shown as gear in this embodiment, the limit element 613 may be in other forms in different embodiments. For example, referring to FIG. 7C, the limit element 613 may be in the form of a pinhole, and the fixer 655 may be in the form of a pin of any form that can achieve the purpose of fixing the limit element 613 by the fixer 655, which is not limited in the present invention.

Figure 8B:
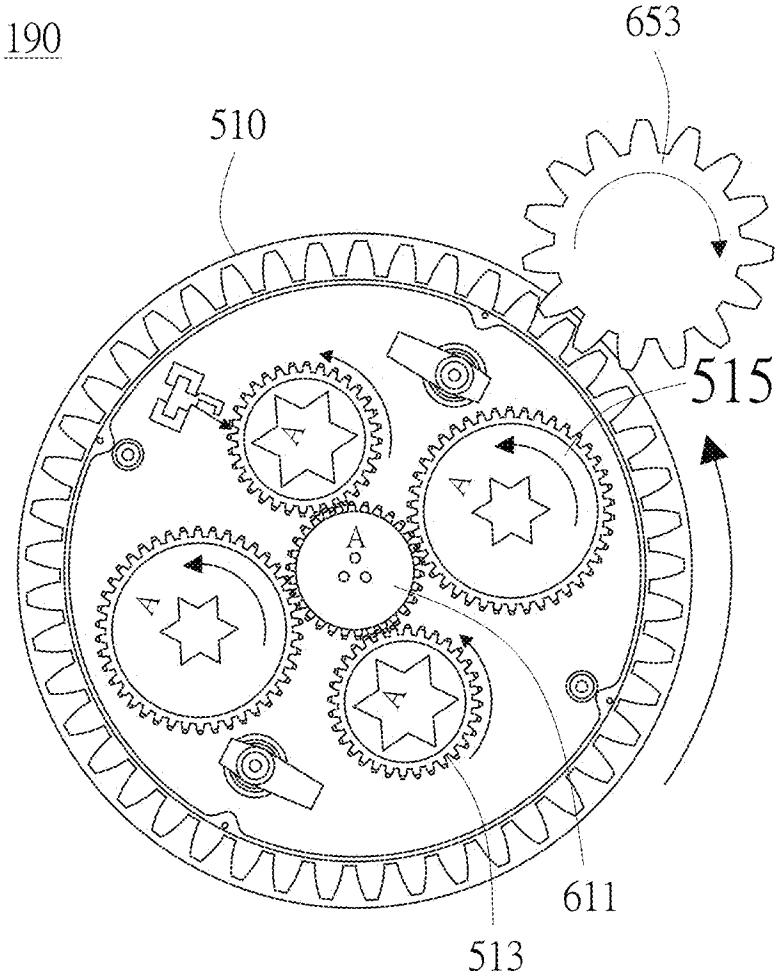
FIG. 8A and FIG. 8B show schematic diagrams of operation mode 1 of the transmission assembly according to the third embodiment of the present invention.
Figure 8A:
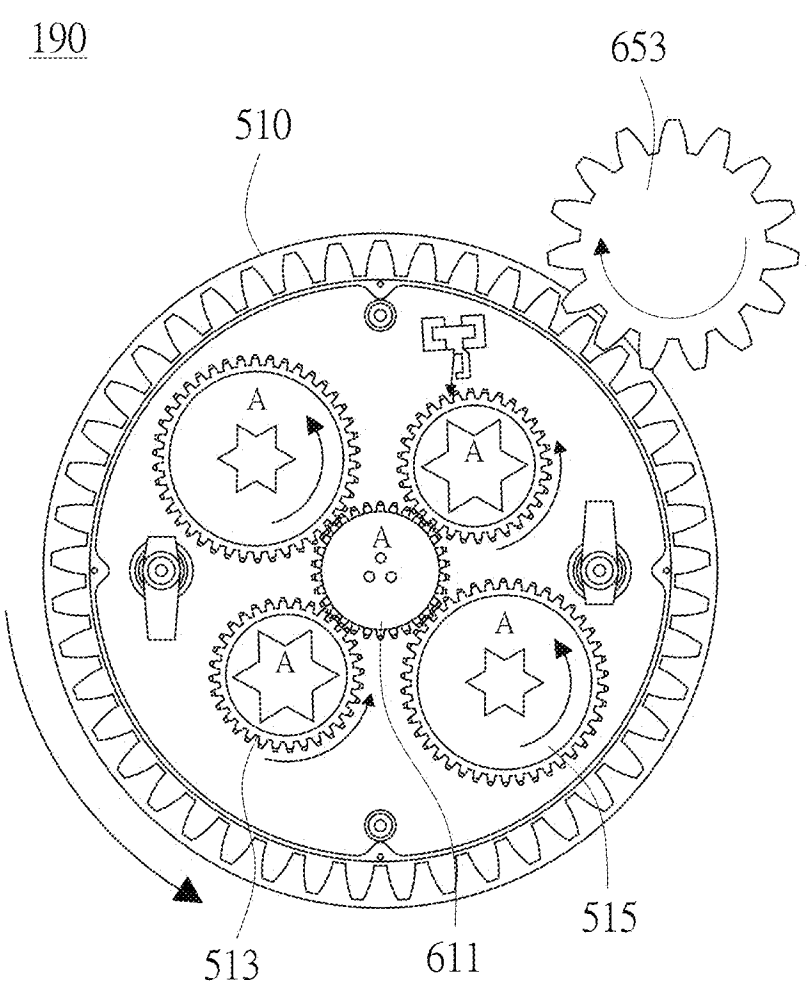
Figure 8D:
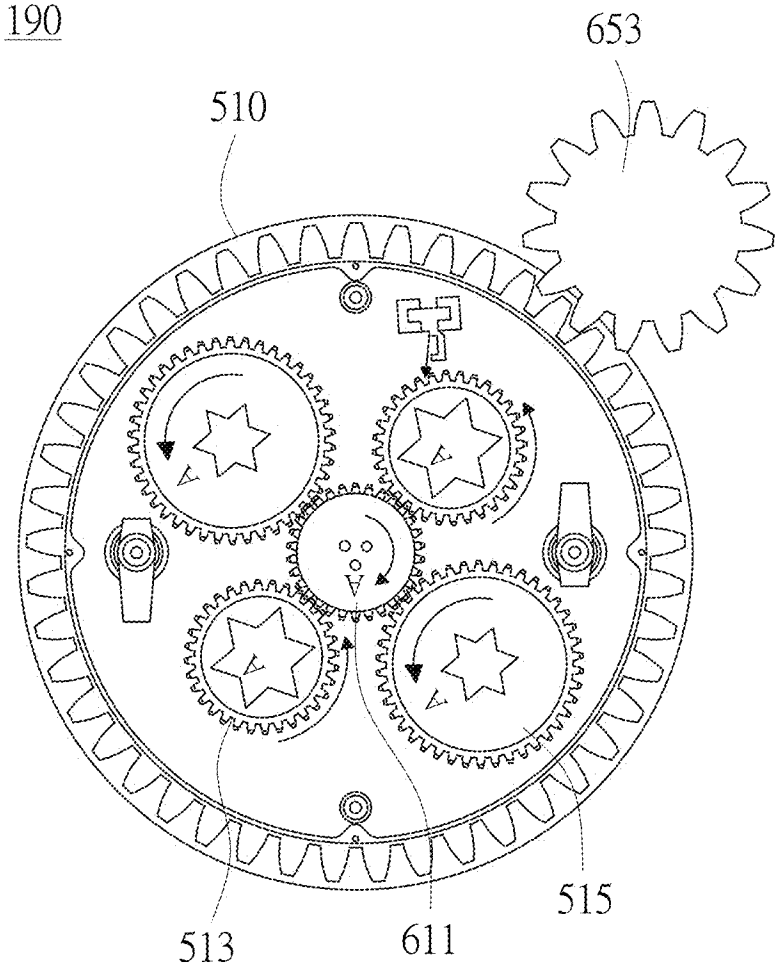
FIG. 8C and FIG. 8D show schematic diagrams of operation mode 2 of the transmission assembly according to a fourth embodiment of the present invention.
Figure 8C:
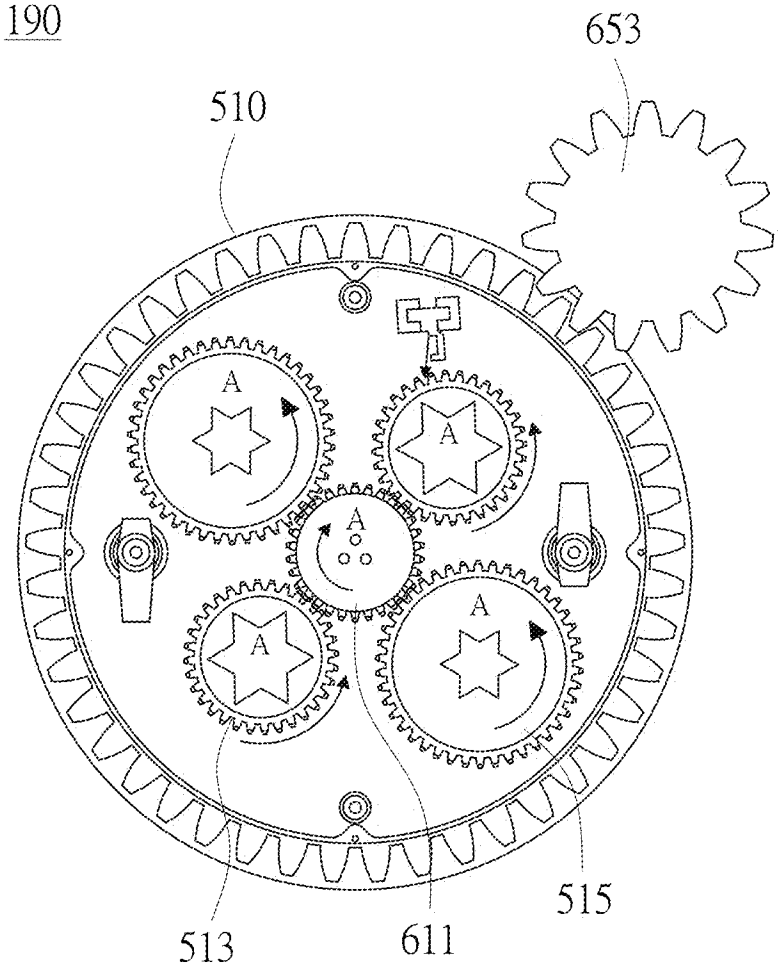

FIG. 8A and FIG. 8B illustrate the first operation mode of the transmission assembly 190 of the above-mentioned embodiment (for the second operation mode, please refer to the related descriptions of FIG. 8C and FIG. 8D). In this embodiment, the driving module 650 further includes a driving gear 653 disposed around the gear plate 510. When the driving module 650 is driven by power, the driving gear 653 will be rotated, and the driving gear 653 can mesh with the gear plate 510. The foregoing description has explained that when the transmission assembly 190 operates, it will drive the first take-up reel 130 and the first supply reel 150 to rotate, thereby achieving the purpose of replacing the middle part 171 of the first cleaning film 170 covering the outer surface 111. The operation of the transmission assembly 190 includes rotating the take-up gear 513 and the supply gear 515, and the structure and process thereof will be described below.

Referring to FIG. 8A and FIG. 8B, since the control gear 611 meshes with the take-up gear 513 and the supply gear 515, when the driving gear 653 meshes with the gear plate 510 and rotates, and the limiting element 613 of the control element 610 is fixed so that the control gear 611 cannot be rotated, the take-up gear 513 and the supply gear 515 start to rotate relative to the fixed control gear 611 (i.e., revolve around the control gear 611) in response to the rotation of the gear plate 510. Due to the meshing relationship between the take-up gear 513 and the supply gear 515 and the control gear 611, the fixed control gear 611 will drive the take-up gear 513 and the supply gear 515 to rotate (self-rotation), thereby making the transmission assembly 190 operate and perform the take-up operation.

It should be noted that, in this embodiment, the number of teeth of the supply gear 515 can be greater than that of the take-up gear 513, so that the rotational speed of the take-up gear 513 and the first take-up reel 130 can be faster than that of the supply gear 515 and the first supply reel 150. Under this configuration, the speed at which the first take-up reel 130 takes up the middle part 171 is faster than the speed at which the first supply reel 150 provides a new middle part 171 so that the first cleaning film 170 can be closely attached to the outer surface 111.

Referring to FIG. 8C and FIG. 8D, the second operation mode of the transmission assembly 190 of the cleaning equipment 400 according to the embodiment of the present invention is illustrated. In this embodiment, the driving gear 653 of the driving module 650 fixes the gear plate 510 so that it cannot rotate, the driving module 650 drives the control gear 611 to rotate, and the control gear 611 simultaneously meshes with the take-up gear 513 and the supply reel gear 515 to rotate to achieve the purpose of replacing the first cleaning film 170 covering the outer surface 111. It should be noted that, as described in the third embodiment, the number of teeth of the supply gear 515 may be greater than that of the take-up gear 513, so that the rotational speed of the take-up gear 513 and the first take-up reel 130 is faster than that of the supply gear 515 and the first supply reel 150. In this configuration, the speed at which the first take-up reel 130 takes up the middle part 171 is faster than the speed at which the first supply reel 150 provides a new middle part 171, so that the first cleaning film 170 can be closely attached to the outer surface 111.

Figure 9A:
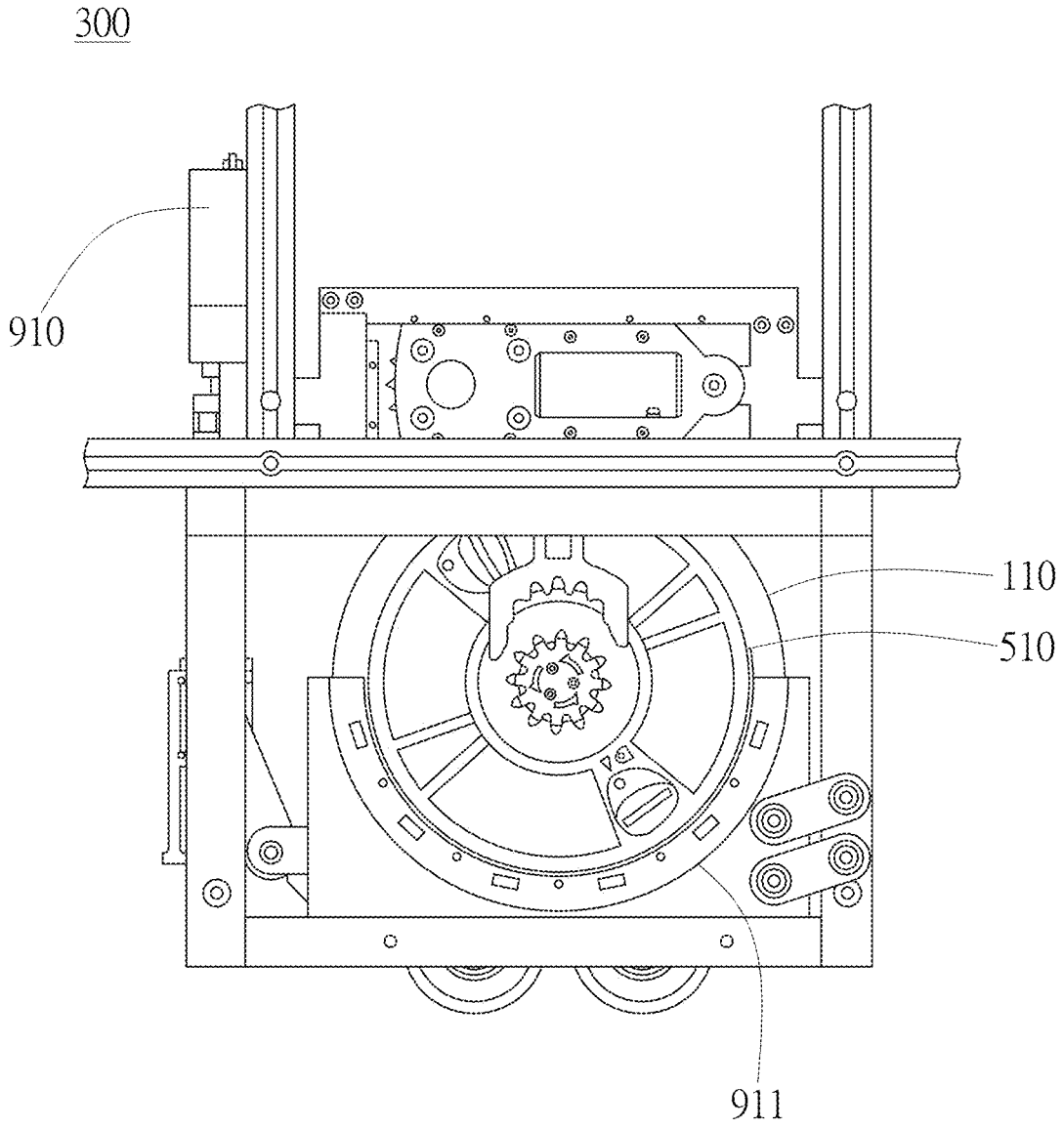
FIG. 9A shows a schematic diagram of the lifting module according to the third embodiment of the present invention.

FIG. 9A continues illustrating the cleaning equipment 300 according to the third embodiment of the present invention. FIG. 9A shows the side structure of the cleaning equipment 300. In this embodiment, the cleaning equipment 300 further includes a lifting module 910 for lifting the frame 110. Specifically, the lifting module 910 includes a supporting element 911 in the shape of a hollow semi-circle, and the diameter of the semi-circle is slightly larger than that of the gear plate 510 so that the hollow part of the semi-circle can properly accommodate and support the gear plate 510. When the lifting module 910 is driven by power to rise, the supporting element 911 will exert an upward force on the gear plate 510, thereby lifting the frame 110. It should be noted that although the supporting element 911 is shown in the form of a hollow semi-circle in this embodiment, in different embodiments, the supporting element 911 can be in other shapes that can properly support the gear plate 510 (for example, a three-quarters circle), which is not limited in the present invention.

Figure 9B:
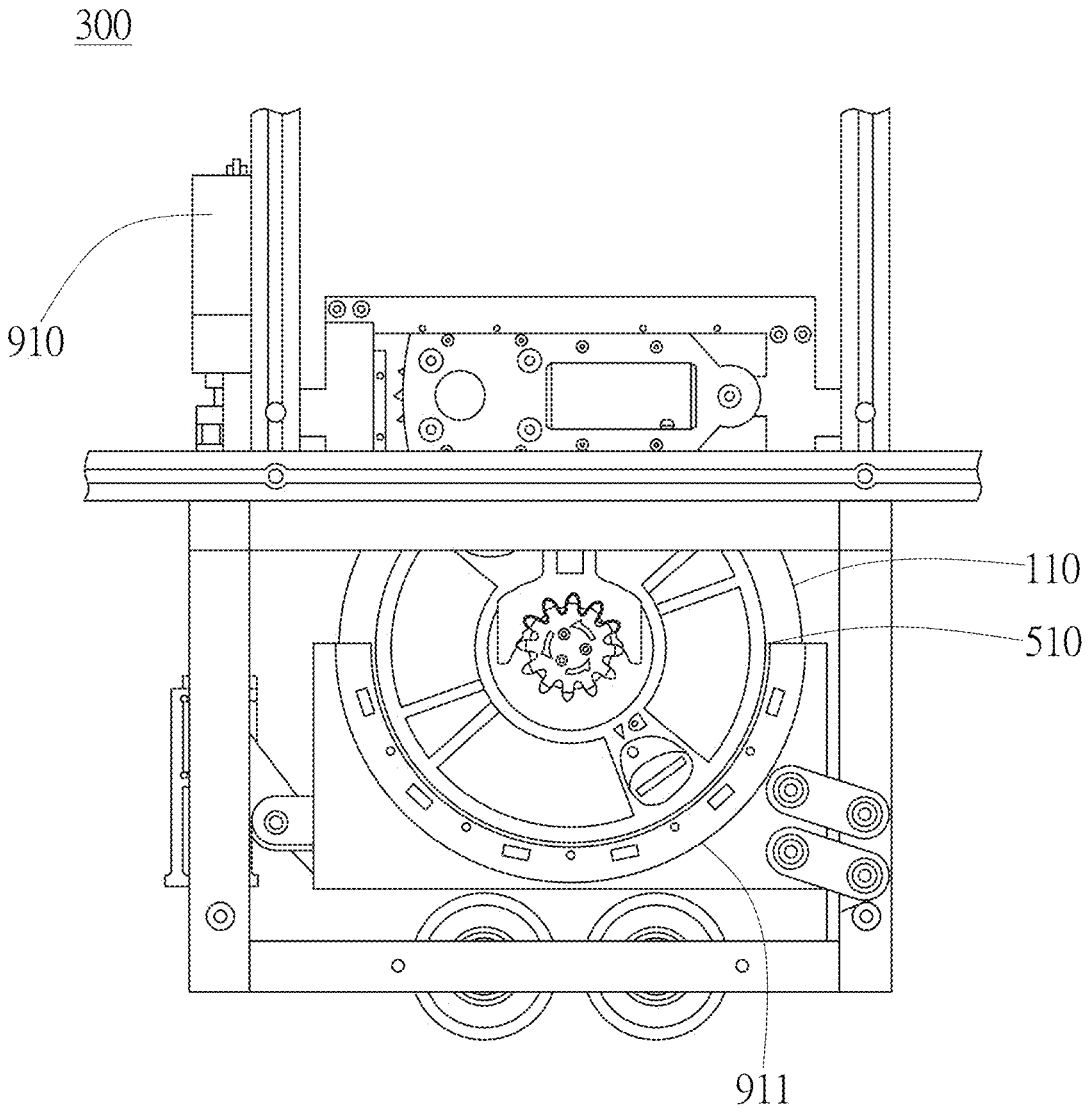
FIG. 9B shows a schematic diagram of the lifting process performed by the lifting module according to the third embodiment of the present invention.

FIG. 9B continues illustrating the cleaning equipment 300 according to the third embodiment of the present invention, FIG. 9B shows a schematic diagram of the lifting module 910 when lifting frame 110. As shown in the figure, when the lifting module 910 lifts frame 110, the cleaning wheel 310 no longer contacts frame 110, and the frame 110 is no longer subjected to the friction force generated by the cleaning wheel 310, and thus stops rotating. In addition, when the lifting module 910 lifts the frame 110, the limit element 613 of the transmission assembly 190 is coupled to the fixer 655 of the driving module 650, and the driving gear 653 of the driving module 650 meshes with the gear plate of the transmission assembly 190 (as shown in FIG. 7B). In this configuration, when the lifting module 910 and the driving module 650 are driven by power, the lifting module 910 lifts the frame 110, the driving module 650 is coupled to the transmission assembly 190, and the driving gear 653 starts to rotate, thereby causing the first take-up reel 130 and the first supply reel 150 to rotate to perform the process of replacing the middle part of the cleaning film as shown in FIG. 8A and FIG. 8B.

FIG. 10A to FIG. 10D illustrate the cleaning equipment 300 according to the third embodiment of the present invention. In this embodiment, the cleaning equipment 300 further includes a monitoring unit 1010, and the monitoring unit 1010 may include a sensor such as a camera. FIG. 10A to FIG. 10D show schematic diagrams of the procedure for replacing the middle part 171 covering the outer surface 111 according to the monitoring result of the monitoring unit 1010. The sensing range of the monitoring unit 1010 includes at least part of the outer surface 111, and thus the monitoring unit 1010 can capture an image containing the middle part 171 covering at least part of the outer surface 111. According to the image, the monitoring unit 1010 can further determine the adsorptive capacity of the middle part 171 of the first cleaning film 170. When the monitoring unit 1010 determines that the adsorptive capacity of the middle part 171 is smaller than a preset threshold, the lifting module 910 and the driving module 650 will be driven to perform the procedure of replacing the middle part 171 of the first cleaning film 170 as illustrated in FIG. 8A and FIG. 8B or FIG. 8C and FIG. 8D.

Figure 10A:
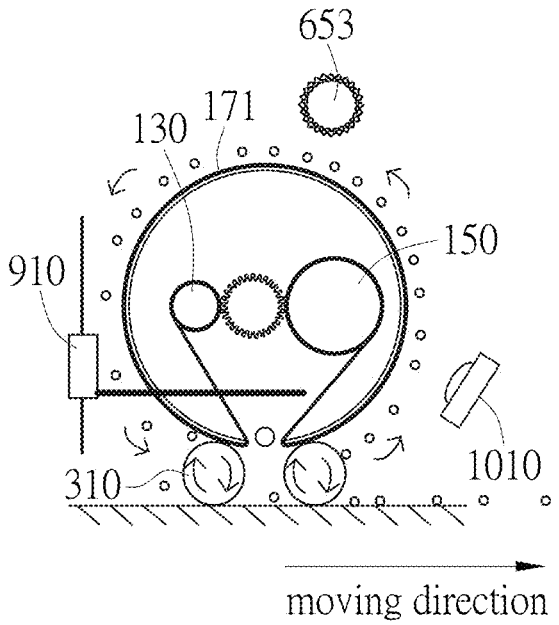
FIG. 10A to FIG. 10D show a schematic diagram of the replacement of the cleaning film covering the outer surface according to the third embodiment of the present invention.
Figure 10B:
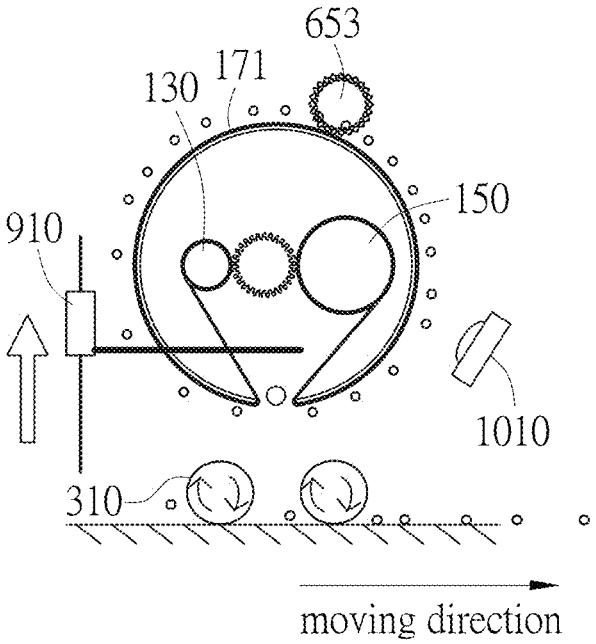
Figure 10C:
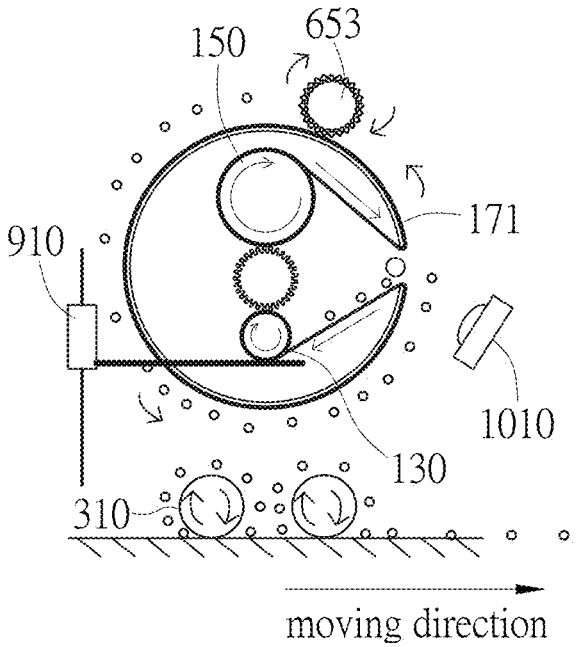
Figure 10D:
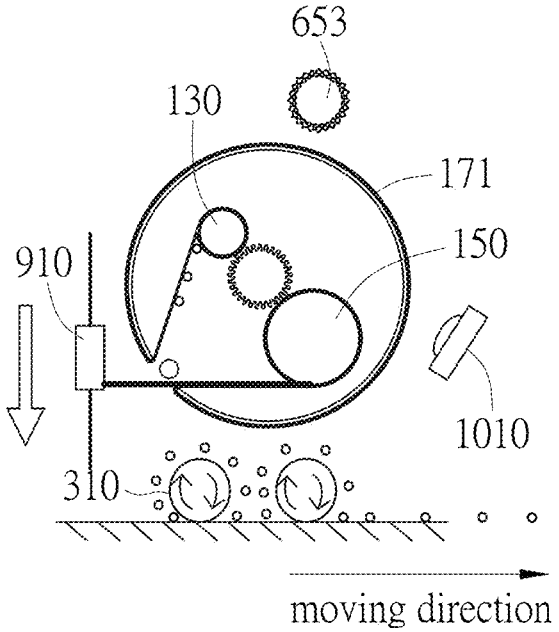

As stated above, when the monitoring unit 1010 determines that the adsorptive capacity of the middle part 171 is smaller than the threshold value (refer to FIG. 10A), the lifting module 910 lifts frame 110, and the frame 110 stops rotating in the meantime (refer to FIG. 10B). Then, the driving module 650 drives the transmission assembly 190 to operate; that is, the driving gear 653 meshes with the gear plate 510 to rotate (and drives the frame 110 to rotate at the same time (refer to FIG. 10C)), so that the first take-up reel 130 takes up the middle part 171 previously adsorbing the dirt, and the first supply reel 150 provides clean middle part 171 to replace it. Finally, when the middle part of the cleaning film is replaced, the lifting module 910 lowers the frame 110 (refer to FIG. 10D). In this configuration, the monitoring unit 1010 can ensure that the middle part 171 maintains the adsorptive capacity. In addition, since the cleaning wheel 310 continues to rotate during the process of replacing the middle part of the cleaning film, the dirt on the target surface will still be adsorbed by the cleaning wheel 310. When the lifting module 910 lowers the frame 110, the middle part contacting the cleaning wheel 310 will adsorb the dirt again to keep the target surface clean.

Figure 11A:
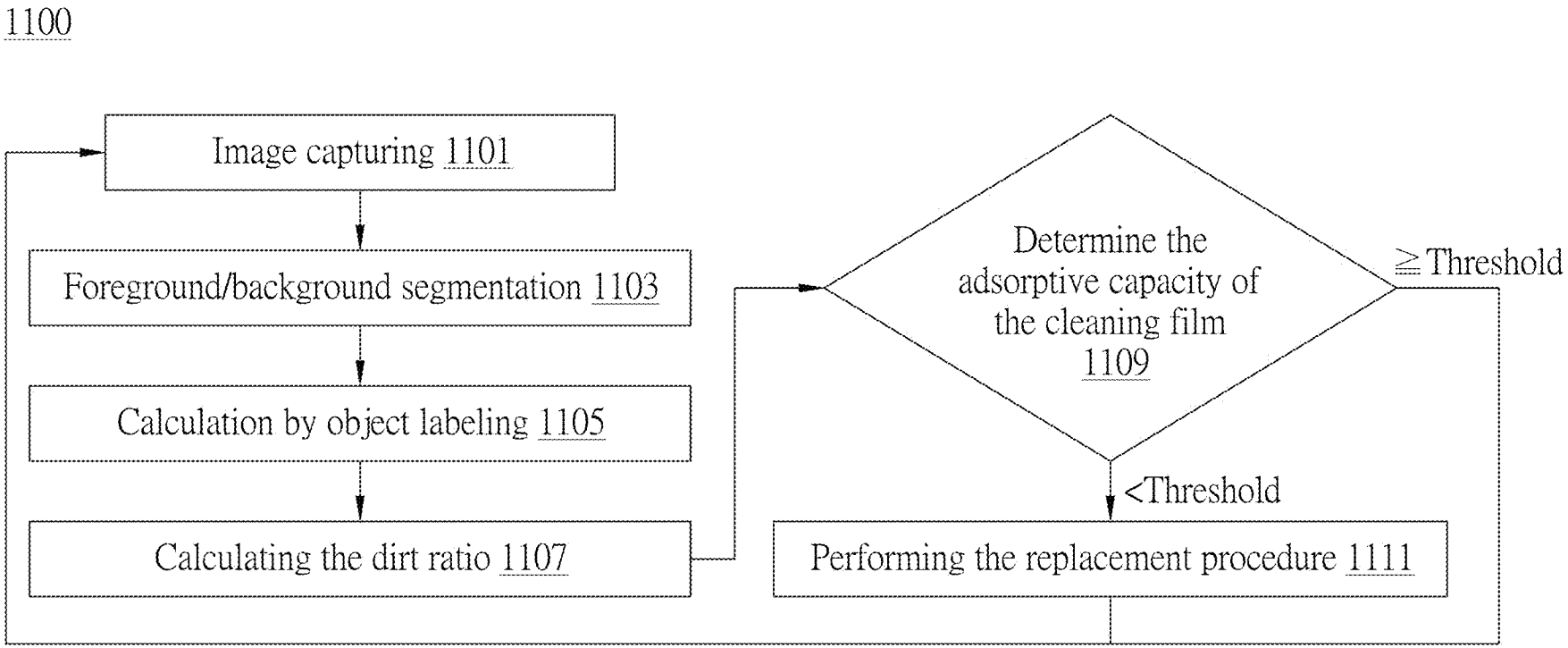
FIG. 11A shows a schematic diagram of the procedure for determining the adsorptive capacity of the cleaning film according to the third embodiment of the present invention.
Figure 11B:
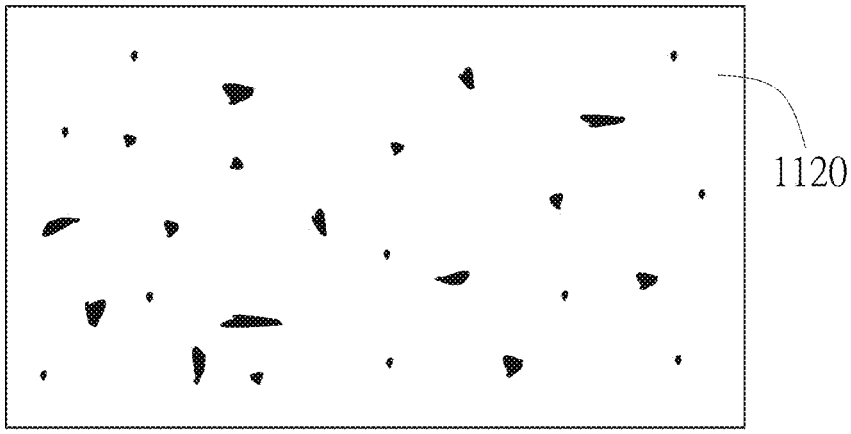
FIG. 11B and FIG. 11C show schematic diagrams of images captured and processed by the monitoring unit according to the third embodiment of the present invention.
Figure 11C:
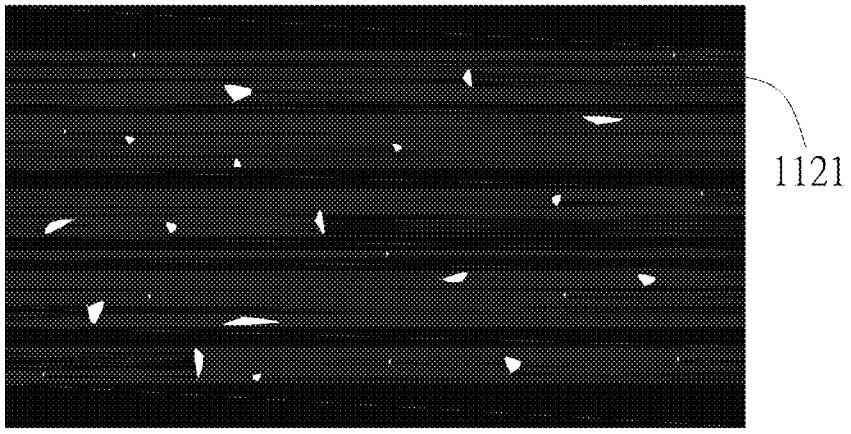

FIG. 11A to FIG. 11C illustrate a procedure 1100 for determining the adsorptive capacity of the middle part 171 according to an embodiment of the present invention. At block 1101, the monitoring unit 1010 captures an image 1120 containing at least part of the middle part 171 (see FIG. 11B). The monitoring unit 1010 may include an image sensor, such as a complementary metal oxide semiconductor (CMOS) or a charge coupled equipment (CCD) image sensor. Referring to FIG. 11B, the background of image 1120 is the first cleaning film 170, and the dots distributed thereon are the dirt adsorbed by the first cleaning film 170. With continued reference to FIG. 11A, at block 1103, appropriate image processing may be performed on image 1120, such as foreground/background segmentation to reveal the dirt (see processed image 1121 shown in FIG. 11C). At block 1105, the condition of the dirt distribution is calculated by object labeling techniques. Then, at block 1107, the dirt ratio (i.e., the ratio of the dirty area to the area of the first cleaning film 170) is calculated according to the calculated dirt distribution. At block 1109, according to the calculated dirt ratio, the monitoring unit 1010 can determine whether the current adsorptive capacity of the middle part 171 of the first cleaning film 170 is smaller than the threshold value (for example, determining that the adsorptive capacity is smaller than the threshold value when the dirt ratio is greater than 85%). At block 1111, when the monitoring unit 1010 determines that the adsorptive capacity of the middle part 171 of the first cleaning film 170 is smaller than the preset threshold, the procedure of replacing the middle part of the cleaning film as described in the foregoing FIG. 10A to FIG. 10D is performed.

Figure 12:
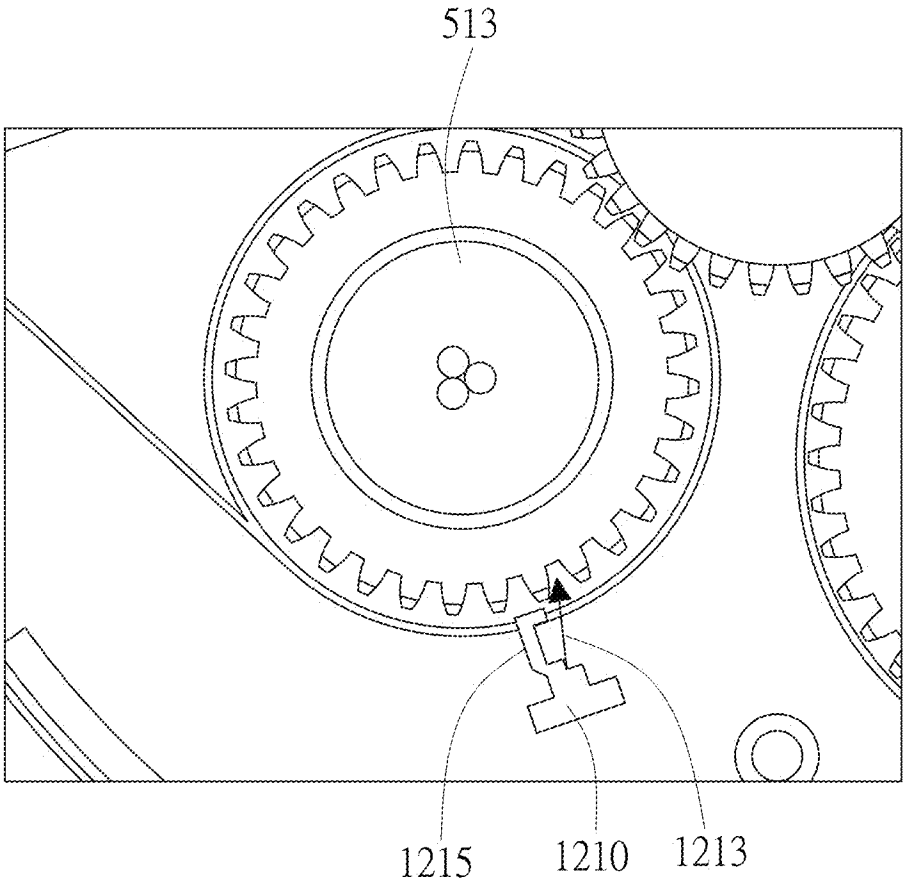
FIG. 12 shows a schematic diagram of the anti-reverse element according to the third embodiment of the present invention.

Referring to FIG. 12, the anti-reverse element 1210 according to the third embodiment of the present invention is illustrated. In this embodiment, the take-up gear 513 and the supply gear 515 are rotated counterclockwise (see FIG. 8A and FIG. 8B). In order to prevent the take-up gear 513 and the supply gear 515 from rotating in the wrong direction (for example, clockwise), causing the middle part 171 that has adsorbed dirt to cover the outer surface 111 of the frame 110 again, and the clean middle part wind back to the first supply reel 150, the embodiment further includes the anti-reverse element 1210. The anti-reverse element 1210 can be arranged beside the take-up gear 513 and/or the supply gear 515. The anti-reverse element 1210 includes a needle end 1213 and a blocking element 1215, and the needle end 1213 is arranged in the tooth space. When the take-up gear 513 and/or the supply gear 515 rotate counterclockwise, the needle end 1213 will be moved in the direction opposite to the blocking element 1215 without being blocked by the blocking element 1215. On the contrary, when the take-up gear 513 and/or the supply gear 515 rotate clockwise, the needle end 1213 will be moved in the direction toward the blocking element 1215, and thus it will be blocked by the blocking element 1215, thereby blocking the take-up gear 513 and/or the supply gear 515 rotating clockwise.

It should be noted that, in this embodiment, although the anti-reverse element 1210 is arranged in a manner to block the clockwise rotation of the take-up gear 513 and/or the supply gear 515, in different embodiments, the anti-reverse element 1210 can be arranged in different ways as required (e.g., in a manner of blocking the counterclockwise rotation of the take-up gear 513 and/or the supply gear 515), which is not limited in the present invention. In addition, the anti-reverse element 1210 can be arranged beside the gear other than the retake-up gear 513 and/or the supply gear. For example, referring to the embodiment of FIG. 8C and FIG. 8D, the anti-reverse element 210 can be arranged beside the control gear 611 to prevent it from rotating counterclockwise.

Figure 13:
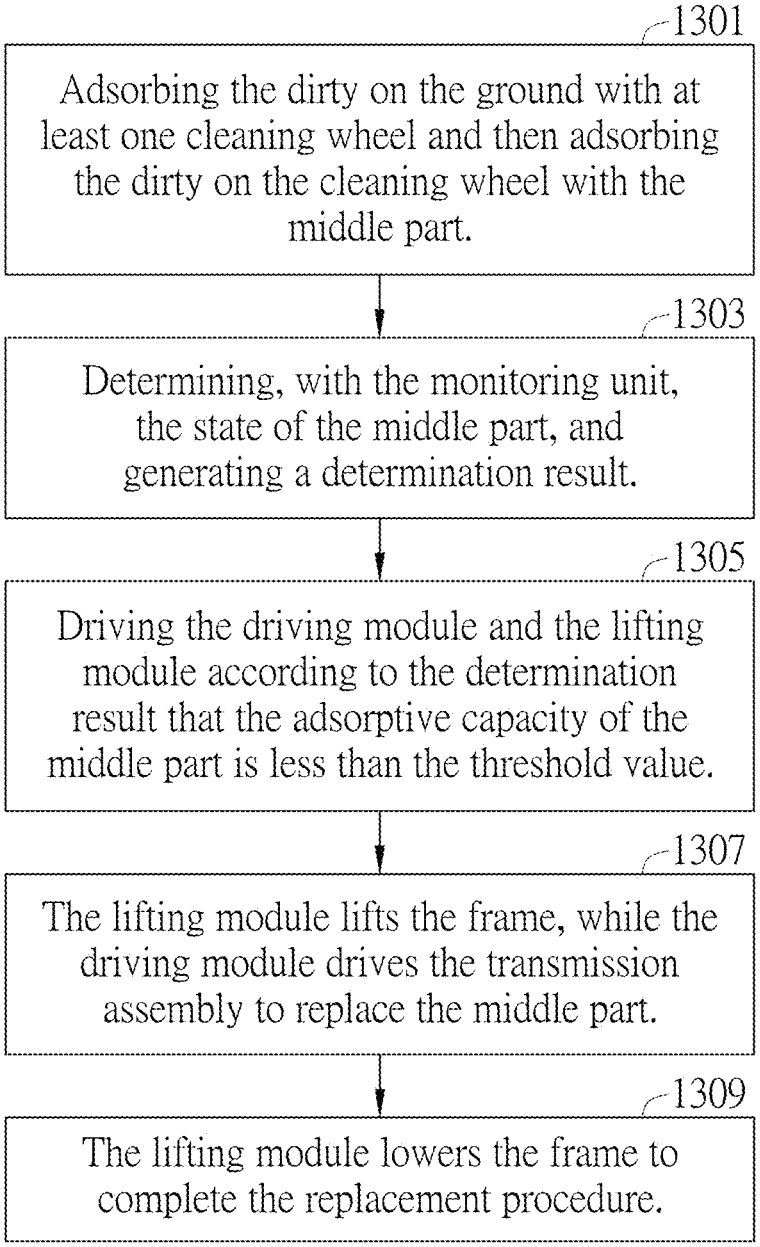
FIG. 13 shows a flow chart of the cleaning method according to a fifth embodiment of the present invention.

Referring to FIG. 13, the fifth embodiment of the present invention provides a cleaning method, which may include the method performed by the cleaning equipment in any of the foregoing embodiments. For example, in this embodiment, the method includes at least the following steps. At step 1301, the method includes adsorbing the dirty on the target surface with at least one cleaning wheel 310 and then adsorbing the dirty on the cleaning wheel 310 with the middle part 171. At step 1303, the method includes determining, with the monitoring unit 1010, the state of the middle part 171, and generating a determination result. At step 1305, the method includes driving the driving module 650 and the lifting module 910 according to the determination result that the adsorptive capacity of the middle part 171 is less than the threshold value. At step 1307, the lifting module 910 lifts the frame 110, while the driving module 650 drives the transmission assembly 190 to replace the middle part 171. At step 1309, the lifting module 910 lowers the frame 110 to complete the replacement procedure of the cleaning film.

Although the preferred embodiments of the invention have been described herein, the above description is merely illustrative. The preferred embodiments disclosed will not limit the scope of the invention. Further modification of the invention herein disclosed will occur to those skilled in the respective arts and all such modifications are deemed to be within the scope of the invention as defined by the appended claims.

What is claimed is:

1. A cleaning equipment, comprising:

a first take-up reel;

a first supply reel;

a frame comprising an outer surface and an inner space located inside the outer surface, wherein the outer surface has at least one gap communicating with the inner space, and the inner space accommodates the first take-up reel and the first supply reel side-by-side;

a first cleaning film with a supply part, a take-up part, and a middle part, wherein the first cleaning film has adsorptive capacity, the supply part is arranged on the first supply reel, the take-up part is arranged on the first take-up reel, at least part of the middle part covers the outer surface of the frame, and two ends of the middle part respectively enter the inner space through the at least one gap and are respectively connected to the supply part and the take-up part;

a transmission assembly coupled to the first supply reel and the first take-up reel and configured to drive at least one of the first supply reel and the first take-up reel to rotate;

a second take-up reel;

a second supply reel;

a second cleaning film with a supply part, and a middle art, wherein the second cleaning film has adsorptive capacity, the supply part is arranged on the second supply reel, the take-up part is arranged on the second take-up reel, and at least part of the middle part covers the outer surface of the frame; and wherein the at least one gap includes a first gap and a second gap, the two ends of the middle part of the first cleaning film are respectively connected to the take-up part and the supply part of the first cleaning film through the first gap and the second gap, and two ends of the middle part of the second cleaning film are respectively connected to the take-up part and the supply part of the second cleaning film through the first gap and the second gap.

2. The equipment of claim 1, wherein the outer surface comprises a first outer surface and a second outer surface, wherein the at least part of the middle part of the first cleaning film covers the first outer surface, the at least part of the middle part of the second cleaning film covers the second outer surface, and the first gap and the second gap are respectively located between the first outer surface and the second outer surface.

3. The equipment of claim 1, wherein the transmission assembly includes a belt configured to drive the first supply reel and the first take-up reel to rotate.

4. The equipment of claim 3, further comprising at least one guard plate, wherein the at least one guard plate is coupled to an end of an axial direction of the frame.

5. The equipment of claim 1, wherein the transmission assembly comprises a gear plate, and a surface of the gear plate facing the frame accommodates at least one supply gear and at least one take-up gear, wherein the supply gear and the take-up gear respectively have a first tenon/mortise element corresponding to a second tenon/mortise element of the first supply reel and the first take-up reel, and the number of teeth of the supply gear is greater than that of the take-up gear.

6. The equipment of claim 5, wherein the transmission assembly further comprises a top plate coupled to the gear plate, the top plate has at least two top-plate holes corresponding to the supply gear and the take-up gear, wherein the first tenon/mortise element is coupled to the second tenon/mortise element through the top-plate holes.

7. The equipment of claim 5, wherein the transmission assembly comprises a control element, a first end of the control element is provided with a control gear configured to mesh with the supply gear and the take-up gear respectively, and second end of the control element passes through a gear-plate hole of the gear plate and protrudes from a surface of the gear plate without accommodating the supply gear and the take-up gear.

8. The equipment of claim 7, wherein the second end of the control element is provided with a limit element, and the limit element is a pinhole or a fix gear.

9. The equipment of claim 8, further comprising a driving module and a lifting module, wherein the lifting module has a supporting element corresponding to the gear plate, wherein when the lifting module operates, the supporting element is in contact with the gear plate to lift the frame, and the driving module and the transmission assembly are power coupled.

10. The equipment of claim 9, wherein the driving module comprises a driving gear and a fixer, wherein when the lifting module lifts the frame, the driving gear is adapted to mesh with the gear plate to rotate, and the fixer fixes the limit element of the control element.

11. The equipment of claim 9, wherein the driving module comprises a driving gear, wherein when the lifting module lifts the frame, the driving gear fixes the gear plate, and the driving module drives the control gear to rotate so that the control gear respectively meshes with the supply gear and the take-up gear to rotate.

12. The equipment of claim 1, further comprising at least one cleaning wheel, wherein the cleaning wheel is disposed of under the frame, the axial direction of the cleaning wheel is parallel to the axial direction of the frame, and the cleaning wheel corresponds to the outer surface to contact the at least part of the middle part of the first cleaning film, wherein the adsorptive capacity of the at least one cleaning wheel is smaller than that of the first cleaning film.

13. The equipment of claim 1, further comprising a monitoring unit facing the outer surface of the frame to monitor the state of the at least part of the middle part of the first cleaning film.

14. The equipment of claim 1, further comprising at least one anti-stick strip located at the at least one gap of the frame, wherein the at least one anti-stick strip does not protrude from the outer surface of the frame, and the extending direction of the anti-stick strip is parallel to the axial direction of the frame.

15. The equipment of claim 7, wherein the transmission assembly further comprises an anti-reverse element disposed beside the supply gear, the take-up gear, or the control gear, wherein the anti-reverse element has no effect when the supply gear, the take-up gear or the control gear rotates in a first direction, and the anti-reverse element prevents the supply gear, the take-up gear, or the control gear from rotating when the supply gear, the take-up gear or the control gear rotates in a second direction.

16. A cleaning method, comprising:

pulling at least part of a first cleaning film arranged on a first supply reel out to leave an inner space of a frame through at least one gap of the frame, cover an outer surface of the frame, and then enter the inner space again through the at least one gap and be arranged on a first take-up reel, wherein the part of the first cleaning film arranged on the first supply reel becomes a supply part, the part covering the outer surface becomes a middle part, and the part arranged on the first take-up reel becomes a take-up part, the first supply reel and the first take-up reel are arranged side by side in the inner space, and the first cleaning film has absorptive capacity;

operating a transmission assembly coupled to the first supply reel and the first take-up reel to drive at least one of the first supply reel and the first take-up reel to rotate, wherein in response to rotation of the first take-up reel, at least part of the middle part becomes the take-up part, and in response to rotation of the first supply reel, at least part of the supply part leaves the first supply reel and becomes at least part of the middle part to cover the outer surface of the frame; and pulling at least part of a second cleaning film arranged on a second supply reel out to leave the inner space of the frame through the at least one gap of the frame, cover the outer surface of the frame, and then enter the inner space again through the at least one gap and be arranged on a second take-up reel, wherein the part of the second cleaning film arranged on the second supply reef becomes a supply part, the part covering the outer surface becomes a middle part, and the part arranged on the second take-up reel becomes a take-up part, the second supply reel and the second take-up reel are arranged side by side in the inner space, and the second cleaning film has absorptive capacity.

17. The method of claim 16, wherein the at least one gap comprises a first gap and a second gap, wherein the two ends of the middle part of each of the first cleaning film and the second cleaning film are respectively connected to the take-up part and the supplying part of the first cleaning film or the second cleaning film through the first gap and the second gap.

18. The method of claim 17, wherein the outer surface comprises a first outer surface and a second outer surface, wherein the at least part of the middle part of the first cleaning film covers the first outer surface, the at least part of the middle part of the second cleaning film covers the second outer surface, and the first gap and the second gap are respectively located between the first outer surface and the second outer surface.

19. The method of claim 16, wherein the transmission assembly comprises a belt, and when at least one of the first supply reel and the first take-up reel is driven to rotate, the belt is configured to drive the not driven one of the first supply reel and the first take-up reel to rotate.

20. The method of claim 19, further comprising coupling at least one guard plate to an end of an axial direction of the frame.

21. The method of claim 16, wherein operating the transmission assembly to drive at least one of the first supply reel and the first take-up reel to rotate comprises:

using a control gear disposed at first end of a control element of the transmission assembly to mesh with a supply gear of the first supply reel, and using the control gear to mesh with a take-up gear coupled to the first take-up reel; and driving the control gear to rotate by a driving module, so as to drive the first supply reel and the first take-up reel to rotate.

22. The method of claim 16, wherein operating the transmission assembly to drive at least one of the first supply reel and the first take-up reel to rotate comprises:

accommodating a supply gear and a take-up gear by a gear plate of the transmission assembly, wherein the supply gear is coupled to the first supply reel and the take-up gear is coupled to the first take-up reel;

using a control gear disposed at first end of a control element of the transmission assembly to mesh with the supply gear and the take-up gear;

fixing the control element and driving the gear plate to rotate by a driving module, wherein the supply gear and the take-up gear rotate relative to the fixed control gear, and in response to the meshing relationship between them, the supply gear and the take-up gear rotates to drive the first supply reel and the first take-up reel to rotate, wherein the rotational speed of the first take-up reel is greater than that of the first supply reel.

23. The method of claim 21, wherein driving the first supply reel and the first take-up reel to rotate by the driving module further comprises:

monitoring the state of the middle part of the first cleaning film by a monitoring unit to determine whether the adsorptive capacity of the middle part is less than a threshold;

lifting the frame by the lifting module in response to the determination that the adsorptive capacity of the middle part is less than the threshold so that the driving module and the transmission assembly are power coupled.

24. The method of claim 23, further comprising driving a cleaning wheel to rotate with power, wherein when the frame is not lifted, at least part of the cleaning wheel contacts the at least part of the middle part of the first cleaning film, to drive the frame to rotate.

25. The method of claim 24, further comprising adsorbing dirt with the cleaning wheel, wherein the adsorptive capacity of the cleaning wheel is smaller than that of the first cleaning film, and the cleaning wheel passes the adsorbed dirt on to the first cleaning film through the at least part of the middle part in contact with the cleaning wheel.

26. The method of claim 25, wherein when the frame is lifted, the cleaning wheel does not contact the first cleaning film, and the cleaning wheel continues to rotate and absorb dirt.

27. The method of claim 16, further comprising disposing at least one anti-stick strip in the at least one gap, wherein the at least one anti-stick strip does not protrude from the outer surface of the frame, and the extending direction of the anti-stick strip is parallel to the axial direction of the frame.

28. The method of claim 21, further comprising disposing an anti-reverse element beside the supply gear, the take-up gear, or the control gear, wherein the anti-reverse element has no effect when the supply gear, the take-up gear or the control gear rotates in a first direction, and the anti-reverse element prevents the supply gear, the take-up gear, or the control gear from rotating when the supply gear, the take-up gear or the control gear rotates in a second direction.

29. A cleaning equipment, comprising:

a first take-up reel;

a first supply reel;

a frame comprising an outer surface and an inner space located inside the outer surface, wherein the outer surface has at least one gap communicating with the inner space, and the inner space accommodates the first take-up reel and the first supply reel side-by-side;

a first cleaning film with a supply part, a take-up part, and a middle part, wherein the first cleaning film has adsorptive capacity, the supply part is arranged on the first supply reel, the take-up part is arranged on the first take-up reel, at least part of the middle part covers the outer surface of the frame, and two ends of the middle part respectively enter the inner space through the at least one gap and are respectively connected to the supply part and the take-up part;

a transmission assembly coupled to the first supply reel and the first take-up reel and configured to drive at least one of the first supply reel and the first take-up reel to rotate; and at least one cleaning wheel, wherein the cleaning wheel is disposed of under the frame, the axial direction of the cleaning wheel is parallel to the axial direction of the frame, and the cleaning wheel corresponds to the outer surface to contact the at least part of the middle part of the first cleaning film, wherein the adsorptive capacity of the at least one cleaning wheel is smaller than that of the first cleaning film.

* * * * *